US009150012B2

(12) United States Patent
Ochiai et al.

(10) Patent No.: US 9,150,012 B2
(45) Date of Patent: Oct. 6, 2015

(54) CONTROL DEVICE FOR PRINTING APPARATUS, CONTROL METHOD, AND STORAGE MEDIUM

(71) Applicant: CANON KABUSHIKI KAISHA, Tokyo (JP)

(72) Inventors: Takashi Ochiai, Machida (JP); Hitoshi Fukamachi, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/632,365

(22) Filed: Feb. 26, 2015

(65) Prior Publication Data

US 2015/0251416 A1 Sep. 10, 2015

(30) Foreign Application Priority Data

Mar. 10, 2014 (JP) ..... 2014-046528

(51) Int. Cl.
*B41J 2/045* (2006.01)

(52) U.S. Cl.
CPC ..... *B41J 2/04573* (2013.01)

(58) Field of Classification Search
CPC .. B41J 2/04543; B41J 2/0458; B41J 2/04573; B41J 3/543; B41J 2/04545; B41J 19/142
USPC ..... 347/9–15, 40–43, 57
See application file for complete search history.

(56) References Cited

U.S. PATENT DOCUMENTS 6,428,138 B1 * 8/2002 Asauchi et al. ..... 347/15

FOREIGN PATENT DOCUMENTS

| | | | |
|---|---|---|---|
| JP | 2002-292859 | A | 10/2002 |
| JP | 2007-090714 | A | 4/2007 |
| JP | 2007-276353 | A | 10/2007 |

* cited by examiner

*Primary Examiner* — Thinh Nguyen
(74) *Attorney, Agent, or Firm* — Carter, DeLuca, Farrell & Schmidt, LLP

(57) ABSTRACT

Raggedness of thin lines or edges is suppressed to improve straightness. For each of the pixels forming image data, each pixel in the image data is assigned to a printing element for outputting a pixel value of the pixel. A control unit controls printing of the image data by driving the plurality of printing elements by time-division driving in which a different driving timing is set to each printing element according to assignment. The control unit drives the printing elements such that the printing elements included in a printing element array are associated with a plurality of different driving timings and further a plurality of printing element arrays have different orders of driving timings for the respective printing elements in an arrangement direction. Distribution information assigns to the pixel a printing element driven at a reference driving timing or a driving timing close to the reference driving timing.

9 Claims, 25 Drawing Sheets

ALLOCATION OF DRIVING BLOCKS TO PRINTING ELEMENTS IN FIRST EMBODIMENT

70

| PRINTING ELEMENT NUMBER # | PRINTING ELEMENT ARRAY | | | | SECTION |
|---|---|---|---|---|---|
| | 51A | 51B | 51C | 51D | |
| 0 | 0 | 1 | 2 | 3 | 1 |
| 1 | 1 | 2 | 3 | 0 | |
| 2 | 2 | 3 | 0 | 1 | |
| 3 | 3 | 0 | 1 | 2 | |
| 4 | 0 | 1 | 2 | 3 | 2 |
| 5 | 1 | 2 | 3 | 0 | |
| 6 | 2 | 3 | 0 | 1 | |
| 7 | 3 | 0 | 1 | 2 | |
| ⋮ | ⋮ | ⋮ | ⋮ | ⋮ | ⋮ |
| 1020 | 0 | 1 | 2 | 3 | 256 |
| 1021 | 1 | 2 | 3 | 0 | |
| 1022 | 2 | 3 | 0 | 1 | |
| 1023 | 3 | 0 | 1 | 2 | |

ALLOCATION OF DRIVING BLOCKS TO PRINTING ELEMENTS

200

| PRINTING ELEMENT NUMBER # | PRINTING ELEMENT ARRAY | | | | SECTION |
|---|---|---|---|---|---|
| | 51A | 51B | 51C | 51D | |
| 0 | 0 | 0 | 0 | 0 | 1 |
| 1 | 1 | 1 | 1 | 1 | |
| 2 | 2 | 2 | 2 | 2 | |
| 3 | 3 | 3 | 3 | 3 | |
| 4 | 0 | 0 | 0 | 0 | 2 |
| 5 | 1 | 1 | 1 | 1 | |
| 6 | 2 | 2 | 2 | 2 | |
| 7 | 3 | 3 | 3 | 3 | |
| ⋮ | ⋮ | ⋮ | ⋮ | ⋮ | ⋮ |
| 1020 | 0 | 0 | 0 | 0 | 256 |
| 1021 | 1 | 1 | 1 | 1 | |
| 1022 | 2 | 2 | 2 | 2 | |
| 1023 | 3 | 3 | 3 | 3 | |

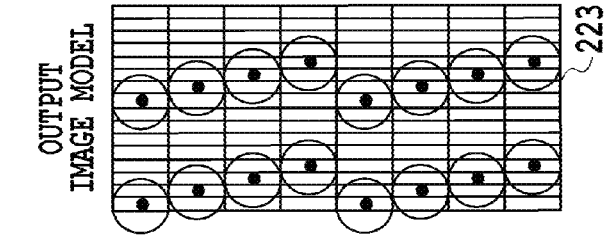
FIG.22C
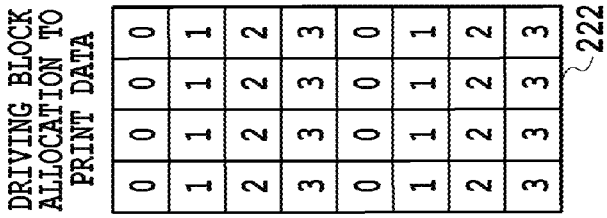
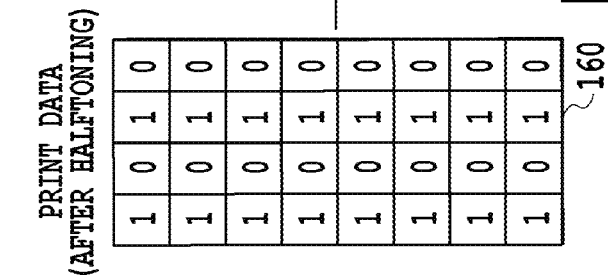
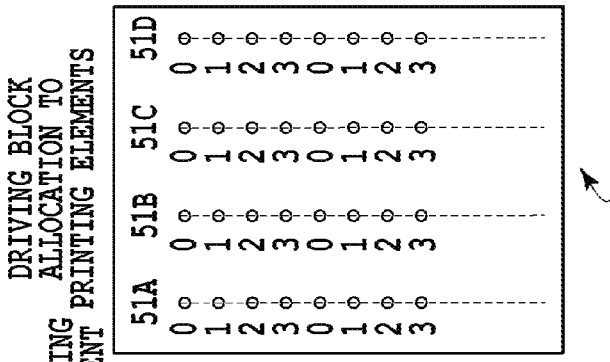
FIG.22B
FIG.22A

BLOCK DIVISION AND ALLOCATION OF DRIVING BLOCKS TO PRINTING ELEMENTS IN SECOND EMBODIMENT

230

| PRINTING ELEMENT NUMBER # | PRINTING ELEMENT ARRAY | | | | SECTION |
|---|---|---|---|---|---|
| | 51A | 51B | 51C | 51D | |
| 0 | 0 | 6 | 4 | 2 | 1 |
| 1 | 7 | 5 | 3 | 1 | |
| 2 | 4 | 2 | 0 | 6 | |
| 3 | 3 | 1 | 7 | 5 | |
| 4 | 1 | 7 | 5 | 3 | |
| 5 | 6 | 4 | 2 | 0 | |
| 6 | 5 | 3 | 1 | 7 | |
| 7 | 2 | 0 | 6 | 4 | |
| ⋮ | ⋮ | ⋮ | ⋮ | ⋮ | ⋮ |
| 1016 | 0 | 6 | 4 | 2 | 128 |
| 1017 | 7 | 5 | 3 | 1 | |
| 1018 | 4 | 2 | 0 | 6 | |
| 1019 | 3 | 1 | 7 | 5 | |
| 1020 | 1 | 7 | 5 | 3 | |
| 1021 | 6 | 4 | 2 | 0 | |
| 1022 | 5 | 3 | 1 | 7 | |
| 1023 | 2 | 0 | 6 | 4 | |

FIG.23

CONTROL DEVICE FOR PRINTING APPARATUS, CONTROL METHOD, AND STORAGE MEDIUM

BACKGROUND OF THE INVENTION

1. Field of the Invention

The present invention relates to a control device for a printing apparatus, a control method, and a storage medium, and more particularly to time-division driving of a plurality of print heads and distribution of print data to the plurality of print heads.

2. Description of the Related Art

Printing apparatuses such as printers or copiers are configured to print images (including letters, symbols, and the like) on print media such as paper by using color material based on print information. The printing apparatuses are classified into an ink jet type, a wire dot type, a thermal type, an electrophotography type (a laser exposure type and an LED exposure type), and the like according to their printing systems. Of these types, a printing apparatus of an ink jet type (an ink jet printing apparatus) performs printing by using an ink jet print head to eject ink droplets from ejection ports of the print head toward a print medium.

Printing methods for the ink jet printing apparatus fall roughly into two types: a multipass system and a full line system. The multipass system repeats the operation of conveying a print medium by a predetermined amount in a direction crossing a direction in which a print head scans the print medium to perform printing over the entire area of the print medium. In the multipass system, the print head performs print scanning multiple times with respect to the same area on the print medium to print an image on the print medium. This can achieve a high image quality at relatively low cost. Therefore, ink jet printing apparatuses for consumers often use this system.

In the full line system, a print head has a printing width corresponding to the width of a print medium, and a print medium is moved so that an image is printed on the print medium. In this case, the print head performs print scanning once on the print medium. Such a print head having a long length and used in the full line system generally often has a configuration in which a plurality of print chips having a short length are arranged in a printing width direction. As compared to the ink jet printing apparatus of the multipass system, the cost of the apparatus body is higher, but it is possible to obtain an output product of a high image quality at high speed. Therefore, the full line system is often used in the ink jet printing apparatuses for POD (Print on Demand) or the like. Today, there is a need for high speed printing of print materials of a high image quality equivalent to that in offset printing, for example, at a high resolution of 1200 dpi×1200 dpi or greater, at a rate of several hundreds of pages to several thousands of pages per minute on a print medium having a Kiku size (152 mm×218 mm). Such a printing apparatus of the full line system is disclosed in, for example, Japanese Patent Laid-Open No. 2002-292859.

For a print head mounted on the printing apparatus of the full line system, a so-called multi-array head is often used, in which a plurality of arrays of printing elements that can print the same color material are arranged in parallel. Providing a plurality of printing element arrays associated with the same color material can print image data associated with a specific color material by a plurality of printing elements. This can suppress degradation in image quality caused by variations in landing positions of dots formed by ink droplets from respective printing elements or by variations in ejection amounts.

Furthermore, since a time difference can be made between landings of adjacent dots on the print medium, it is possible to suppress degradation in image quality caused when dots which have landed on the print medium coalesce into one to form an inappropriate shape.

Each of the printing elements provided for the plurality of printing element arrays generally has a system using an electrothermal transducer element (heater) or a system using a piezoelectric element. Both systems control ejection of ink droplets by electric signals.

Printing elements in printing element arrays are arranged at a high density of, for example, 600 dpi. To downsize power sources for driving heads and members for power sources such as connectors and cables, the printing elements are often driven by a time-division driving system. In the time-division driving system, a plurality of printing elements are divided into sections, each including a predetermined number of printing elements. Then, each section is segmented into a plurality of driving blocks and the printing elements for each driving block are divided by time to be driven.

With reference to the attached drawings, the case of driving a print head by the time-division driving system will be described in detail.

FIG. 1 is a schematic view of ejection port arrays of a print head, driving signals for ejection ports, and ink droplets ejected from the ejection ports. In FIG. 1, an ejection port array 1 of a print head consists of 32 ejection ports, for example, and these ejection ports are divided into four sections, each section including eight ejection ports. Furthermore, each of the eight ejection ports in each section belongs to one of eight driving blocks, and is time-division driven for each driving block in printing. More specifically, ejection ports belonging to the same driving block in different sections are simultaneously driven.

In an example shown in FIG. 1, the number of segments is 8, and ejection ports are periodically assigned to one of the driving blocks, for example, four ejection ports (1st, 9th, 17th, and 25th ejection ports) in the ejection port array 1 to a first driving block, and another four ejection ports (2nd, 10th, 18th, and 26th ejection ports) to an eighth driving block. Then, the ejection ports from the first driving block to the eighth driving block are sequentially driven by pulse driving signals as shown in FIG. 1, and ink droplets 3 as shown in FIG. 1 are ejected from the respective ejection ports in response to the driving signals.

Time-division driving by pulse driving signals 2 with a time difference in ejection timings of ink droplets between driving blocks causes ink droplets to be ejected at different timings as shown in FIG. 1. Therefore, a time difference also occurs between timings at which dots by the ink droplets land on the print medium. As a result, dots shift from their ideal landing positions, and image quality may degrade. In particular, a thin line in a direction along an ejection port array direction may be misaligned due to variations in driving timings, and deterioration in image quality may easily be recognized.

As described, the technique of solving the problem of ragged lines is disclosed, for example, in Japanese Patent Laid-Open Nos. 2007-276353 and 2007-090714.

Japanese Patent Laid-Open No. 2007-276353 discloses a printing method in which the number of blocks driven in a single printing element array is reduced to 1/N and portions to be printed by the printing elements in a non-driven block are assigned to another print pass or another ejection port array for the same ink color. In this method, a time difference of block driving occurring in a single printing element array is reduced to 1/N, so as to reduce a shift of a landing position from an ideal position.

Further, Japanese Patent Laid-Open No. 2007-090714 discloses a driving method in which a plurality of printing element arrays are driven in different block driving orders. This method can reduce raggedness of lines.

Today, however, in ink jet printing apparatuses for POD printing or the like, there is an increasing need for high-definition output of image data, like offset printing. The above-described related art can reduce raggedness of thin lines, but a further improvement is required for such a need.

With respect to such a need, the method disclosed in Japanese Patent Laid-Open No. 2007-276353 can reduce raggedness of vertical lines, but variations in positions caused by a time difference in block driving after restriction still remain, and thus it cannot be said that the raggedness can be sufficiently reduced. As N increases, load on processing to another pass (another ejection port array in the full line system) and the number of passes increase. Therefore, it is difficult to indiscriminately increase a value of N in actuality.

With respect to such a need, the method disclosed in Japanese Patent Laid-Open No. 2007-090714 can reduce raggedness of vertical lines like Japanese Patent Laid-Open No. 2007-276353, but raggedness of thin lines still remains since block driving orders are different between printing element arrays.

SUMMARY OF THE INVENTION

An object of the present invention is to provide a control device for a printing apparatus in which deterioration in image quality caused by differences in timings of time-division driving can be suppressed, in particular, raggedness of thin lines and edges can be suppressed, a control method, and a storage medium.

In one aspect of a device according to the present invention, there is provided a control device for a printing apparatus provided with a print head in which a plurality of printing element arrays each having a plurality of printing elements arranged therein are placed in parallel in a direction crossing an arrangement direction of the printing elements, wherein the print head and a print medium opposite to the print head are relatively moved in the direction crossing the arrangement direction of the printing elements to print an image on the print medium by the print head, the control device comprising: an acquisition unit configured to acquire image data; a distribution unit configured to assign each pixel in the image data to a printing element for outputting a pixel value of the pixel according to distribution information indicating that each of the pixels forming the image data is associated with one of the plurality of printing elements; and a control unit configured to control printing of the image data by driving the plurality of printing elements by time-division driving in which a different driving timing is set for each printing element according to assignment by the distribution unit, wherein the control unit drives the printing elements such that the printing elements included in the printing element array are associated with a plurality of different driving timings and further the plurality of printing element arrays have different orders of driving timings for the respective printing elements in the arrangement direction of the printing elements, and the distribution information is set such that, with respect to a pixel group corresponding to the arrangement direction of the printing elements, of the printing elements that can print a pixel included in the pixel group, a printing element driven at a reference driving timing or a driving timing close to the reference driving timing is assigned to the pixel.

In another aspect of a device according to the present invention, there is provided a control device for a printing apparatus provided with a print head in which a plurality of printing element arrays each having a plurality of printing elements arranged therein are placed in parallel in a direction crossing an arrangement direction of the printing elements, wherein the print head and a print medium opposite to the print head are relatively moved in the direction crossing the arrangement direction of the printing elements to print an image on the print medium by the print head, the control device comprising: an acquisition unit configured to acquire image data representing a dot arrangement for each pixel; a distribution unit configured to assign each pixel in the image data to a printing element for outputting a pixel value of the pixel according to distribution information indicating that each of the pixels forming the image data is associated with one of the plurality of printing elements; and a control unit configured to control printing of the image data by driving each printing element at a predetermined driving timing according to assignment by the distribution unit, wherein the control unit drives the printing elements such that the printing elements included in the printing element array are associated with a plurality of different driving timings and further the plurality of printing element arrays have different orders of driving timings for the respective printing elements in the arrangement direction of the printing elements, and the distribution information assigns printing elements driven at the same driving timing to all pixels in the arrangement direction of the printing elements.

The present invention further provides a printing apparatus having a device according to the above aspects, a computer program for causing a computer to function as the device according to the above aspects, and a control method carried out in the device according to the above aspects.

According to the present invention, it is possible to suppress deterioration in image quality caused by differences in timings of time-division driving, in particular, raggedness of thin lines and edges.

Further features of the present invention will become apparent from the following description of exemplary embodiments (with reference to the attached drawings).

BRIEF DESCRIPTION OF THE DRAWINGS

FIGS. 22A to 22C are diagrams showing exemplary driving blocks and an exemplary output image according to the comparative example;

FIG. 23 is a diagram showing exemplary driving blocks allocated to printing elements according to a second embodiment;

DESCRIPTION OF THE EMBODIMENTS

Figure 1:
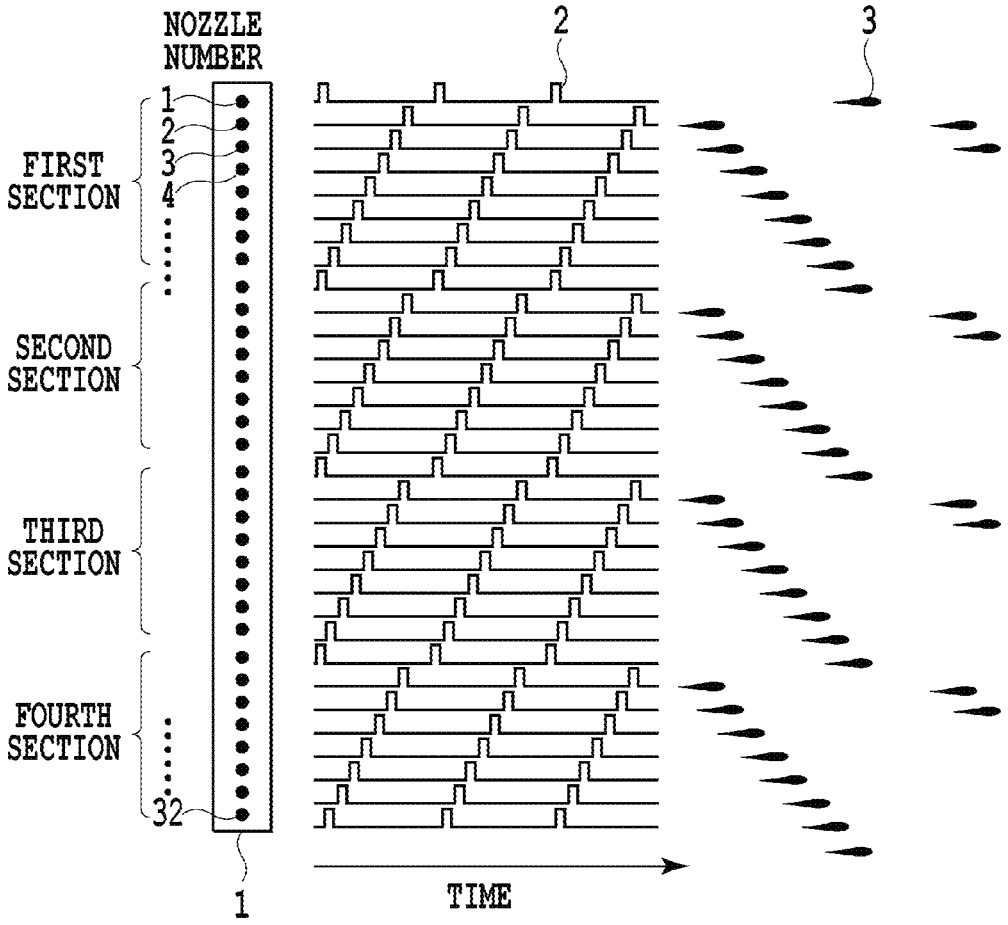
FIG. 1 is a schematic view of a conventional example in a case where an ink jet print head is driven by a time-division driving system.

Preferred embodiments of the present invention will now be described with reference to the attached drawings. It should be noted that the configurations shown in the following embodiments are given by way of illustration, and the present invention should not be limited to the configurations shown in the drawings.

First Embodiment

<Basic Configuration of an Ink Jet Printing Apparatus (FIG. 2)>

Figure 2:
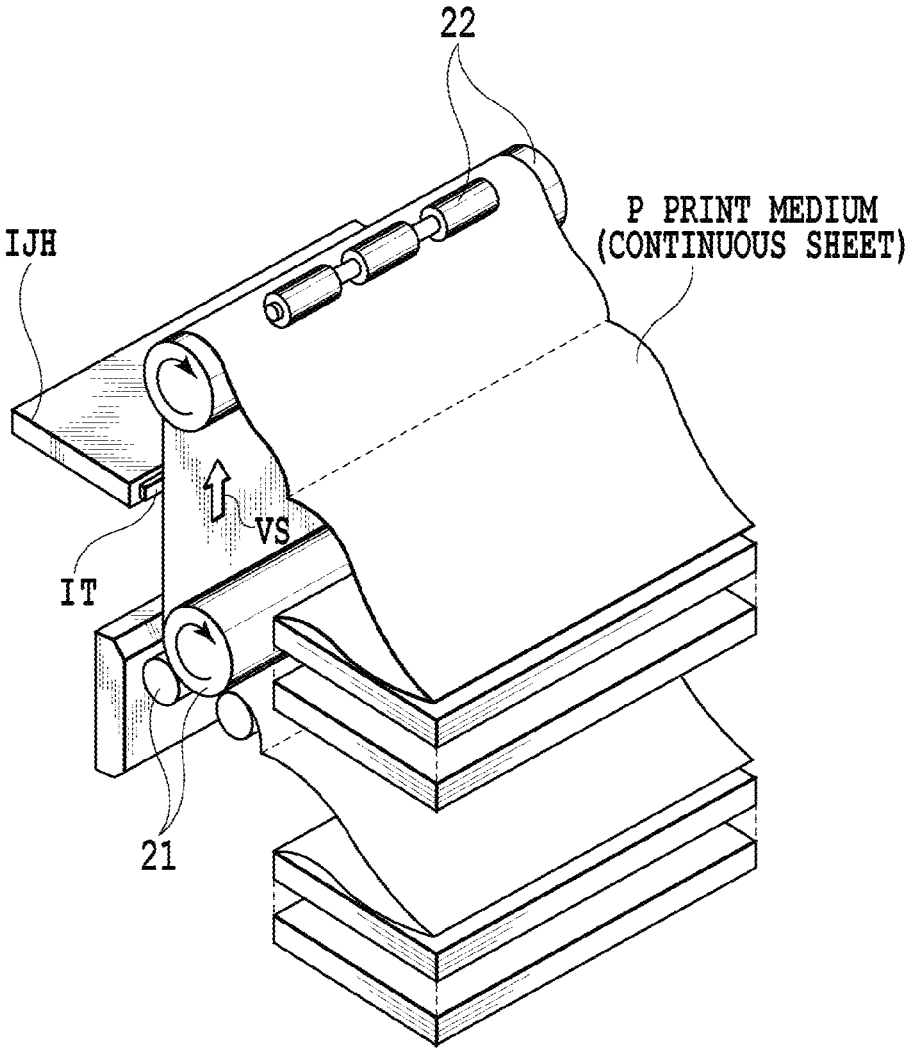
FIG. 2 is a perspective view of an appearance showing the configuration of a main part of an ink jet type printer.

FIG. 2 is a perspective view of an appearance showing the configuration of a main part of an ink jet type printer (ink jet printing apparatus) according to a first embodiment. The ink jet type printer according to the present embodiment has a configuration in which a full line print head IJH that ejects ink across the entire width of a print medium P (continuous fanfold paper is shown as an example, but other type may also be used) is arranged as shown in FIG. 2. From printing elements of a print head chip IT of the print head IJH opposite to the print medium P, ink is ejected to the print medium P at fixed timings for printing on the print medium P.

The printer moves the print head IJH and the print medium P relative to each other for printing. In the present embodiment, a conveying motor is driven according to control of a control circuit as will be described so that the print medium P is conveyed in VS direction (referred to as a main scanning direction in the full line type) shown in FIG. 2 to print an image on the print medium P. In FIG. 2, in a state in which a discharge roller 22 works together with a conveying roller 21 to hold the print medium P at a printing position, the conveying roller 21 is driven by a drive motor (not shown) and the print medium P is conveyed in the arrow VS direction to move relative to the print head IJH.

The print head IJH is connected to an ink supply tube (not shown) and can perform printing by ejecting ink from ink jet printing elements. Further, each ink jet printing element used in the present embodiment is provided with a heat generating element (electrothermal transducer) that generates thermal energy for ink ejection at an internal portion (liquid channel) that is in communication with the printing element.

While FIG. 2 shows continuous fanfold paper as the print medium P, the print medium P may be roll paper or cut paper. Further, while FIG. 2 shows a configuration in which the print head IJH of the full line type is provided, it is also possible to provide two or more full line print heads having the same configuration for each color, for example, for high image quality printing or high speed printing. Alternatively, it is possible to employ the configuration of performing color printing with, for example, four colors: cyan, magenta, yellow, and black.

<Basic Configuration of a Print Head (FIG. 3)>

Figure 3:
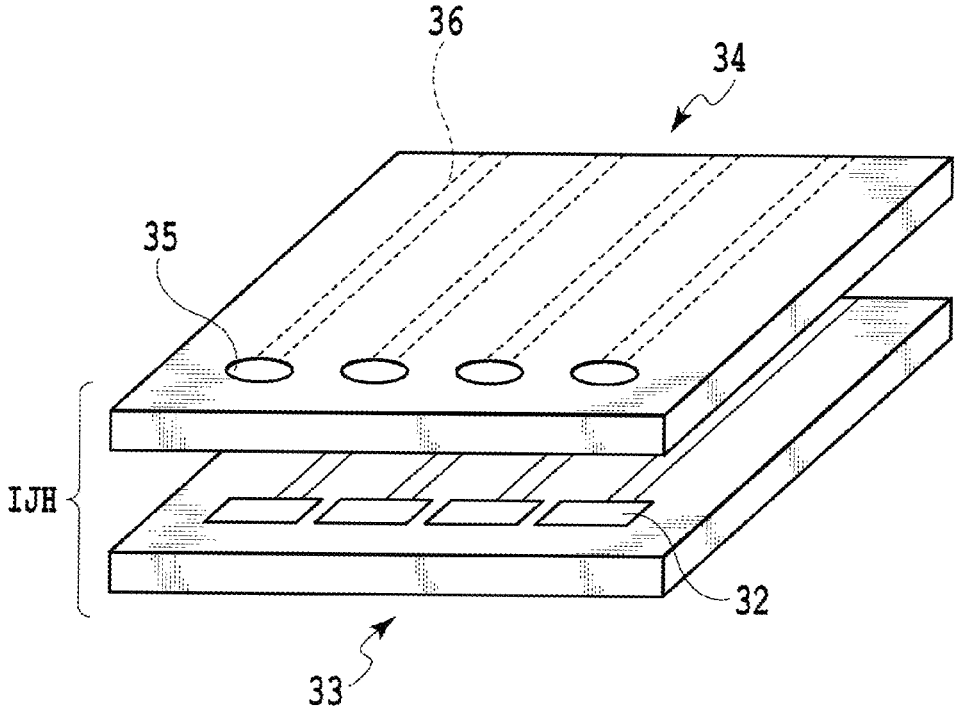
FIG. 3 is an exploded perspective view showing the configuration of a main part of a print head.

FIG. 3 is an exploded perspective view showing the configuration of a main part of the above-described print head IJH. The print head IJH consists of a heater board 33 provided with a plurality of heaters (heat generating elements) 32 for heating ink and a top plate 34 for covering the heater board 33. The top plate 34 is provided with a plurality of printing elements 35, and to the rear of each printing element 35, a liquid channel 36 in a tunnel shape that is in communication with each printing element 35 is formed. The liquid channels 36 are commonly in communication with one ink chamber (not shown) at the rear part of the liquid channels 36. The ink chamber is provided with ink through an ink supply port (not shown), and ink is supplied from the ink chamber to each liquid channel 36.

As shown in FIG. 3, the heater board 33 and the top plate 34 are assembled so that the heaters 32 are located in a manner corresponding to the liquid channels 36. In FIG. 3, four printing elements 35, four heaters 32, and four liquid channels 36 are shown for illustration, and the respective heaters 32 are arranged in a manner corresponding to the respective liquid channels 36. Further, in the print head IJH assembled as shown in FIG. 3, ink on the heater 32 to which a predetermined driving pulse is supplied is boiled to form bubbles. The volume expansion of the bubbles causes the ink to be forced and ejected from the printing element 35.

Note that the ink jet printing system is not limited to the system using a heat generating element (heater).

Various modification examples can be employed also for the configuration of the print head. For example, the ink jet printing system may be a system that ejects ink by using pressures by a piezoelectric element. Examples of a continuous type that continuously injects ink droplets for granulation include a charge control type and a divergence control type. Further, in a case where the ink jet printing system is an on-demand type that ejects ink droplets as necessary, the ink jet printing system may be a pressure control system or the like that ejects ink droplets from an orifice by vibration of a piezoelectric element.

<Control Configuration of an Ink Jet Printing Apparatus (FIG. 4)>

Figure 4:
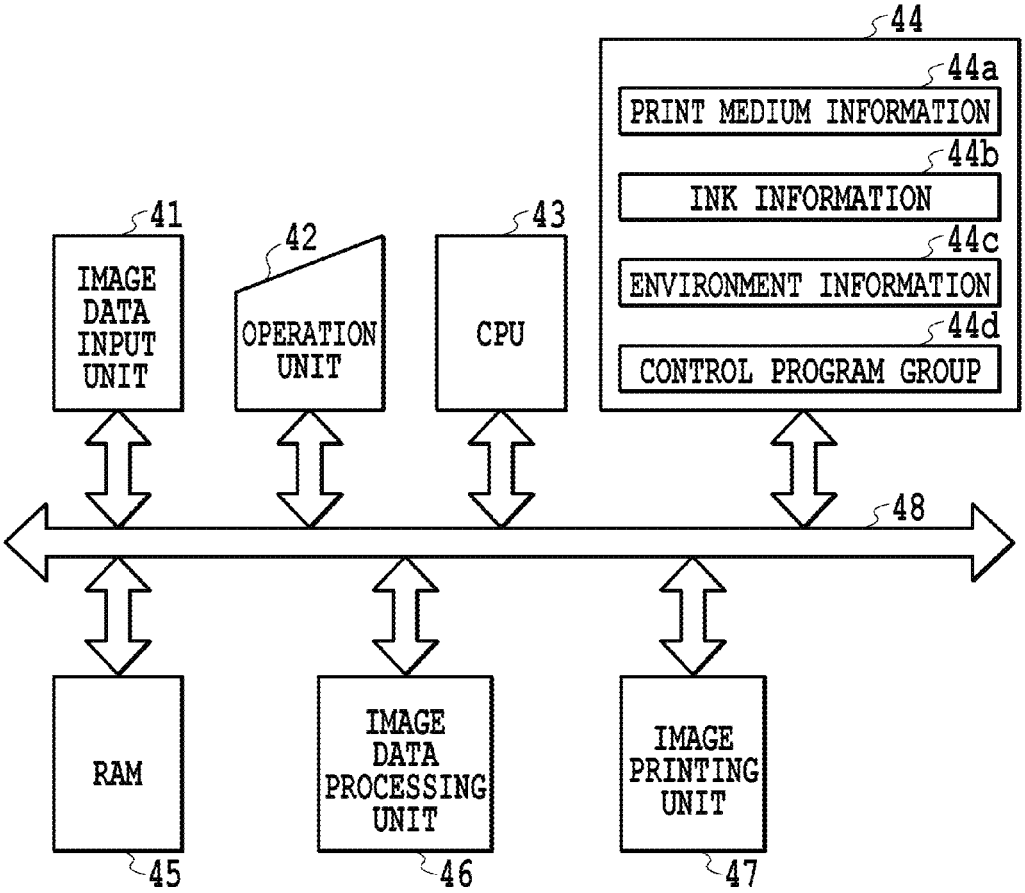
FIG. 4 is a block diagram of an exemplary configuration of a control system of the printer.

FIG. 4 is a block diagram of an exemplary configuration of a control system of an ink jet type printer according to the first embodiment.

A CPU 43 has control over the present printer according to various control programs. A storage medium 44 stores control programs for the CPU 43 to control the present printer and the like. In the present embodiment, under the control by the CPU 43, an image printing unit 47 that is included in the printer outputs an image as will be described. Further, the storage medium 44 stores print medium information 44*a* relating to a type of print medium, ink information 44*b* used for printing, and environment information 44*c* relating to environment such as temperature and humidity of a printer at the time of printing. As the storage medium 44, a ROM, an FD, a CD-ROM, a HD, a memory card, a magneto-optical disk, and the like can be used. A RAM 45 is used as a work area for the various programs in the storage medium 44, a temporary save area for data at the time of error processing, and a work area at the time of image processing. Furthermore, under the control by the CPU 43, various tables in the storage medium 44 may be copied to the RAM 45 to change the content of the tables, and image processing may be performed with reference to the changed tables.

An image data input unit 41 inputs multivalued image data from an image input device such as a scanner or a digital camera, a hard disk such as a personal computer, or the like. An operation unit 42 is provided with various keys for instructing settings of various parameters and starting of printing. Address signals, data, control signals, or the like in the present printer are transmitted or received through a bus unit 48.

An image data processing unit 46 applies various kinds of image processing such as color matching, color separation, Y correction, and resolution conversion, onto image data input through the image data input unit 41. Then, the multivalued image data obtained as a result of the processing is quantized and converted into binary image data for each pixel. For example, in the present embodiment, the image data processing unit 46 performs binarization by dither processing which will be described later, but the binarization may be performed by other arbitrary methods such as an error diffusion method or an average density preservation method.

An image printing unit 47 forms a dot image on a print medium by ejecting ink from corresponding printing elements 35 based on binary image data created by the image data processing unit 46. Details of the image printing unit 47 will be described later.

<Dither Processing (FIG. 5)>

Figure 5:
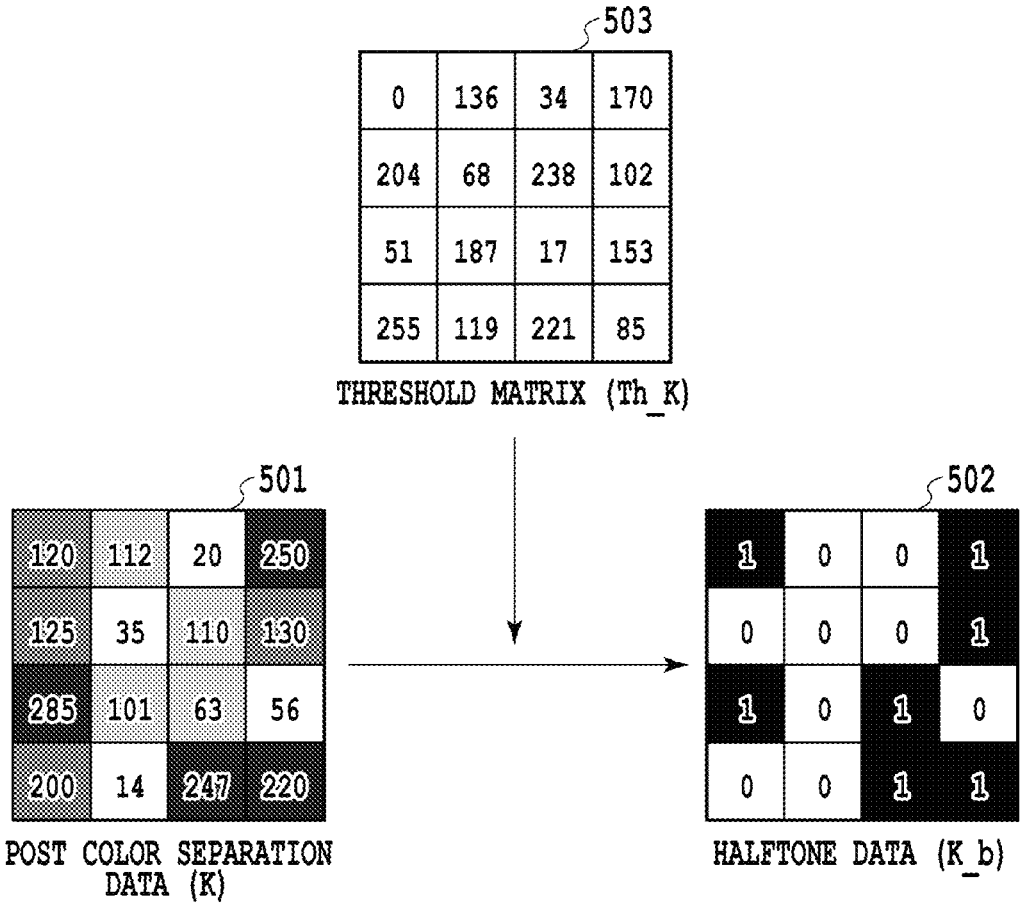
FIG. 5 illustrates dither processing.

FIG. 5 illustrates dither processing for converting multivalued image data into binary image data. The image data processing unit 46 quantizes post color separation data 501 obtained after color separation processing based on a threshold matrix 503 and converts the quantized data to halftone data 502 obtained after halftone processing. In the threshold matrix 503 of the present embodiment, thresholds are arranged so as to have blue noise properties. The blue noise properties indicate frequency properties in a dot arrangement in output halftone data, which properties relatively include more high-frequency components than low-frequency components. It is known that dither processing by using a threshold matrix having the blue noise properties can generate halftone data that has as high dispersion properties as those in an error diffusion method.

A calculation method of dither processing will now be explained. For example, a pixel value of black in the post color separation data 501 is set as K, a threshold in the threshold matrix 503 for dither processing on black is set as Th_K. Halftone data K_b can be represented by the following equation (1) and equation (2):

$$\text{if } K<Th_K,\ K_b=0 \quad (1)$$

$$\text{if } Th_K\leq K,\ K_b=1 \quad (2).$$

<Configuration of a Head (FIG. 6)>

Figure 6:
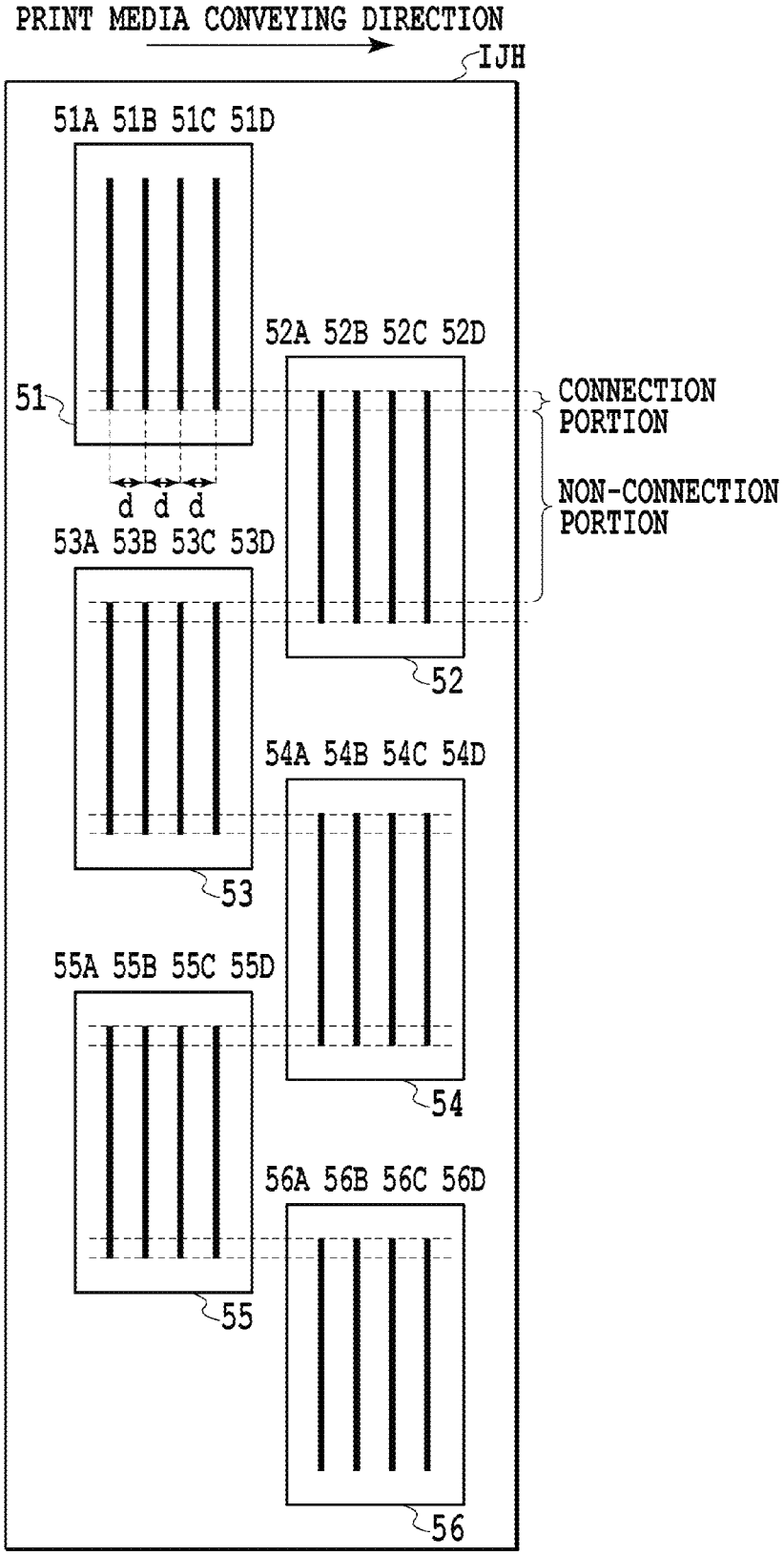
FIG. 6 is a diagram showing a schematic configuration of the print head.

FIG. 6 is a diagram showing a schematic configuration of the print head IJH provided for the printing apparatus according to the first embodiment. In the print head IJH, a plurality of print head chips and printing element arrays in each print head chip are arranged. The print head IJH of the present embodiment is provided with chip-shaped components (hereinafter referred to as print chips) 51 to 56 having a relatively short length in an arrangement direction of printing elements. The print chips 51 to 56 are staggered with respect to one another in the arrangement direction of printing elements to form the print head IJH having a long length. More specifically, a print chip is staggered with respect to its connecting print chip in a direction perpendicular to the arrangement direction of printing elements (main scanning direction).

All of the printing element arrays in each of the print chips 51 to 56 have the same configuration. By way of example, the configuration of the print chip 51 will be described. As described above, the print chip 51 has four printing element arrays 51A, 51B, 51C, and 51D arranged in parallel with each other, each having 1024 printing elements at a resolution of 1200 dpi. Further, all of the printing element arrays A, B, C, and D provided for each of the print chips 51 to 56 eject ink of the same color. In the present embodiment, an example of the case where the printing element arrays in each of the print chips 51 to 56 eject ink of black color will be described. Any other ink color may be used such as cyan, magenta, and yellow, or special colors of similar colors having different densities such as red, blue, and green.

Incidentally, the printing element arrays A, B, C, and D are separated from each other by a predetermined distance d in a direction in which a print medium is conveyed. Timings at which ink is ejected from the printing element arrays A, B, C, and D vary so that pixels in one of the lines in the arrangement direction of printing elements of image data to be printed align on the print medium in the arrangement direction of printing elements.

More specifically, after ink is ejected from the printing elements in the printing element array A, ink is ejected from the printing elements in the printing element array B at a timing at which the print medium is conveyed by a distance d in the right direction in FIG. 6. Then, after ink is ejected from the printing elements in the printing element array C at a timing at which the print medium is further conveyed by a distance d in the right direction in FIG. 6, ink is ejected from the printing elements in the printing element array D at a timing at which the print medium is further conveyed by a distance d in the right direction in FIG. 6. In this manner, for each one of the lines of the image data, different ejection timings of ink from the printing elements are set for the respective printing element arrays so that the pixels in the line align.

In FIG. 6, in the print chips 51 and 52, for example, predetermined printing elements (not shown) are arranged in an overlapping manner in the arrangement direction of printing elements. The overlapping portion is referred to as a connection portion. On the other hand, a portion other than the connection portion is referred to as a non-connection portion. The arrangement of the print chips in an overlapping manner produces an effect of suppressing stripes on the print medium at positions corresponding to connection portions between print chips. In the present embodiment, the number of overlapping printing elements between the print chips is 32, for example.

<Time-Division Driving of a Print Head (FIGS. 7 and 8)>

Figure 7:
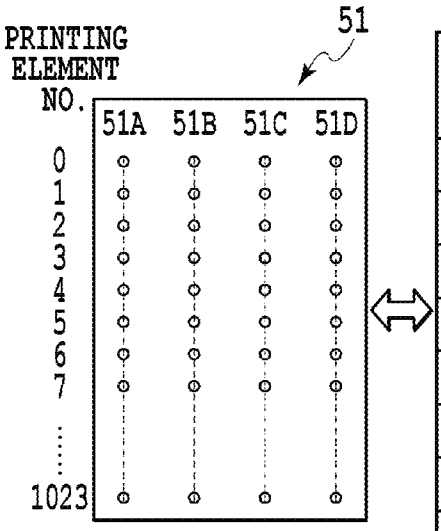
FIG. 7 is a diagram showing exemplary driving blocks allocated to printing elements.

FIG. 7 is a diagram showing driving blocks allocated to the printing elements in each printing element array according to the first embodiment. The printing elements in the printing element arrays 51A, 51B, 51C, and 51D arranged in the print chip 51 are shown with printing element Nos. 0 to 1023. To the printing elements, driving blocks (0 to 3) are allocated as shown in a driving block allocation table 70. The printing element arrays 51A, 51B, 51C, and 51D are segmented into 256 sections, from section 1 to section 256, each including four printing elements, from the printing element of printing element No. 0. In addition, each of the four printing elements in each section belongs to one of the four driving blocks so that the printing elements are time-division driven for each block in printing. More specifically, the printing elements belonging to the same block in the same printing element array are driven at the same timing for each block and the printing elements belonging to a different block in the same printing element array are driven at one of four different timings. Furthermore, the printing elements in the same block in another printing element array are driven with a delay corresponding to a distance d at a different timing as described with reference to FIG. 6.

In an example shown in the driving block allocation table 70, a first driving block (0) is assigned to 256 printing elements, that is, every four printing elements, from the printing element of printing element No. 0 in the printing element array 51A. Likewise, a second driving block (1) is assigned to 256 printing elements, that is, every four printing elements, from the printing element of printing element No. 1 in the printing element array 51A. Further, a third driving block (2) is assigned to 256 printing elements, that is, every four printing elements, from the printing element of printing element No. 2 in the printing element array 51A. Still further, a fourth driving block (3) is assigned to 256 printing elements, that is, every four printing elements, from the printing element of printing element No. 3 in the printing element array 51A.

Also with respect to the printing element arrays 51B, 51C, and 51D, as shown in the driving block allocation table 70, four driving blocks (0 to 3) are allocated like the printing element array 51A. An algorithm for driving order allocation in block-division driving shown in the driving block allocation table 70 will be described later in detail.

Figure 8:
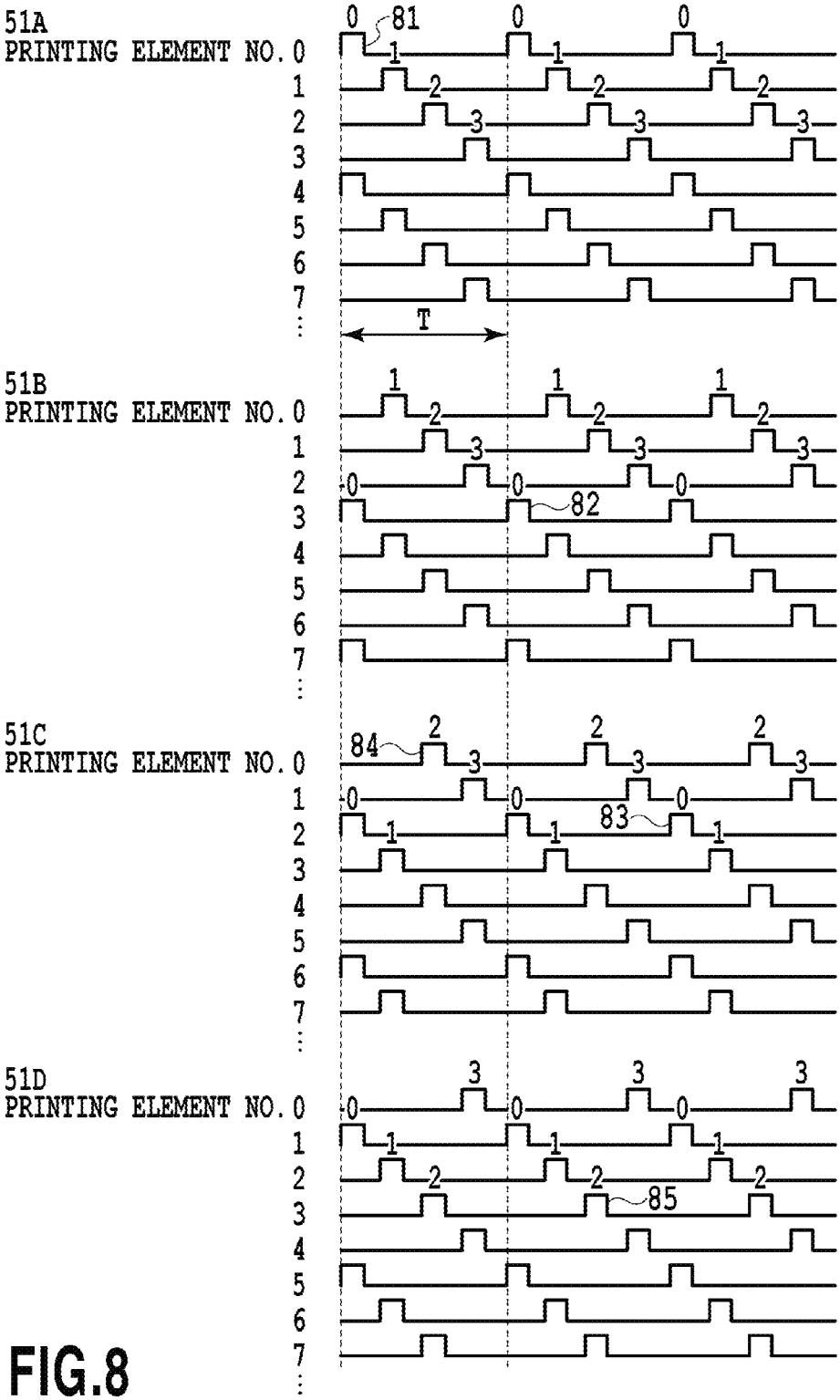
FIG. 8 is a timing diagram showing a driving timing for each printing element.

FIG. 8 is a timing diagram showing a timing of a pulse driving signal for determining a driving timing of a heater corresponding to each printing element according to the first embodiment.

FIG. 8 shows timings of driving signals for the printing elements of printing element Nos. 0 to 7 with respect to the printing element arrays 51A, 51B, 51C, and 51D. The printing elements in each of the printing element arrays 51A, 51B, 51C, and 51D are sequentially driven by pulse driving signals in ascending numeric order from the first driving block (0) to the fourth driving block (3). Here, numbers given to the driving signals correspond to block numbers of the driving blocks in the driving block allocation table 70, and a time interval T is a time required for the print medium to be conveyed by a predetermined distance d.

<Configuration of a Distribution Mask and Driving Order Allocation in Block-Division Driving (FIGS. 9 to 15C)>

Figure 9:
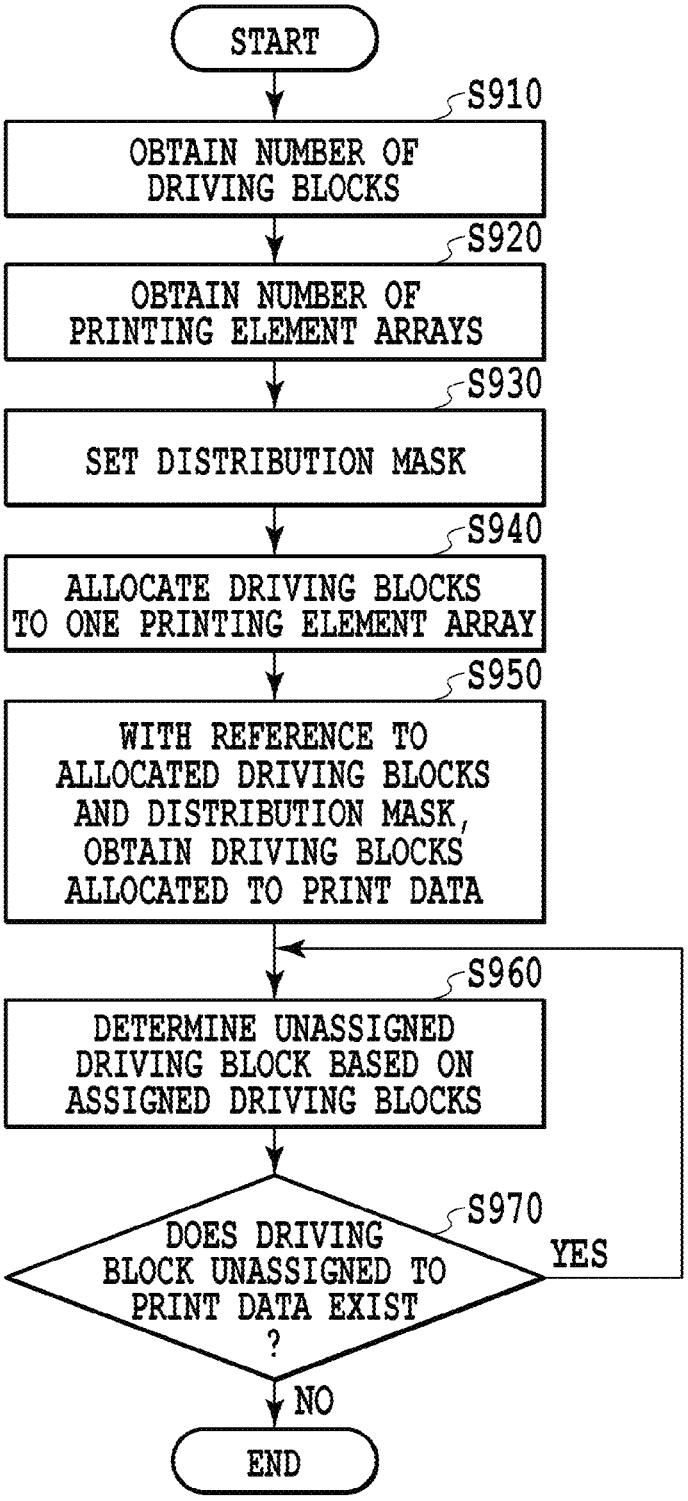
FIG. 9 is a flowchart based on a configuration method of a distribution mask and an algorithm for driving order allocation in block-division driving.

A configuration method of a distribution mask used in the present embodiment and an algorithm for assigning a driving order (driving block) in block-division driving as shown in the driving block allocation table 70 will be described. FIG. 9 is a flowchart showing a processing content based on the allocation algorithm and FIGS. 10A to 15C are diagrams showing specific processing transition.

In S910, a number of driving blocks N is obtained and in S920, a number of printing element arrays L is obtained. In the present embodiment, N=L=4.

Figure 10C:
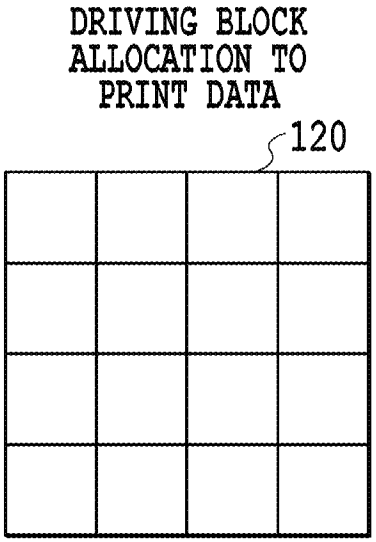
FIGS. 10A to 10C are schematic diagrams specifically illustrating the processing content of the flowchart of FIG. 9.
Figure 10B:
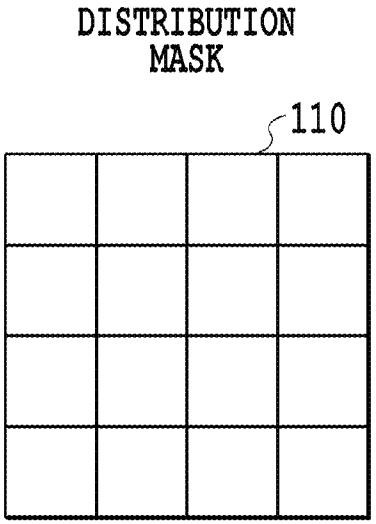
Figure 10A:
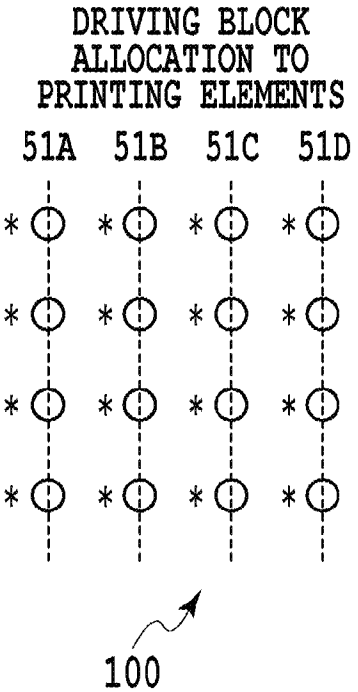
Figure 11A:
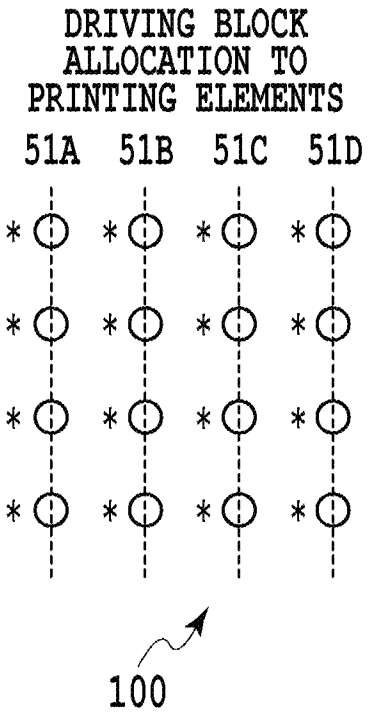
FIGS. 11A to 11C are schematic diagrams specifically illustrating the processing content of the flowchart of FIG. 9.
Figure 11B:
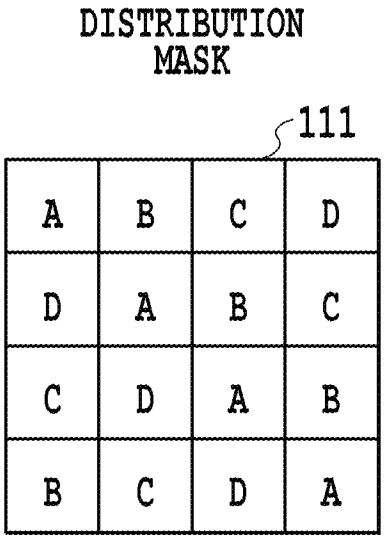
Figure 11C:
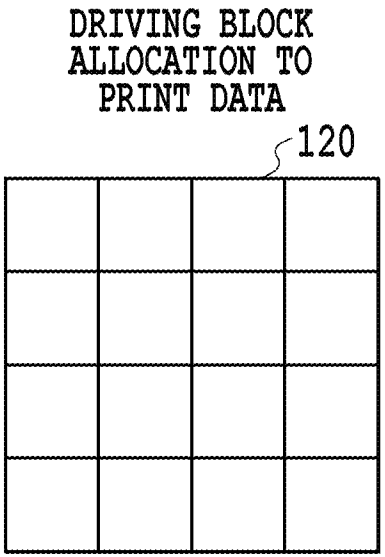

Here, a memory for storing a value of a driving block to be assigned to each printing element in each printing element array, a memory for configuring a distribution mask, and a memory for representing driving blocks allocated to print data are prepared. These memories are shown in FIGS. 10A to 10C, for example, by asterisks (*) in FIG. 10A, a matrix 110 in FIG. 10B, and a matrix 120 in FIG. 10C, respectively. The size of the matrix depends on the number of driving blocks and the number of printing element arrays. The asterisk (*) as used herein means that the content of the memory is undefined (yet to be defined).

In the following S930, a distribution mask is set. When a driving block of each printing element as shown in FIG. 7 is set, a distribution mask 111 is set such that each column includes one each of A, B, C, and D as shown in the distribution mask 111 of FIG. 11B. The inventor has found that this is preferable to obtain more favorable straightness. The distribution mask is set so that driving timings in a direction corresponding to the arrangement direction of printing elements in the printing element arrays (a vertical direction in this case) are the same. For example, in the leftmost column in the distribution mask 111 of FIG. 11B, the printing element arrays A, D, C, and B are stored. All of these printing element arrays are set so as to perform printing at a driving timing "0". However, the configuration of the distribution mask according to the present embodiment is not limited to the configuration shown in FIG. 11B. The distribution mask may have any configuration as long as a line of pixels in the arrangement direction of printing elements in printing element arrays (a vertical direction in this case) is assigned to printing element arrays driven at the same driving timing as possible. More specifically, a printing element array assigned to a target pixel is determined based on a driving timing of another pixel located in the same arrangement direction of the printing elements as the target pixel. If the same printing element array is assigned to each pixel in the same line in the vertical direction, in the case of the present embodiment, printing is performed at four different driving timings, causing distortion of a straight line, that is, raggedness. According to the present embodiment, it is set such that a printing element array for printing each pixel is assigned to have the same driving timing in the vertical direction as possible. Accordingly, the number of driving timings at which pixels in a vertical line are printed is less than the number of driving timings in a case where all of the driving timings are different. More specifically, in the case of FIG. 11B, a line, which is printed at four driving timings if all of the driving timings are different, is printed at a single driving timing, which is less than the four driving timings.

Figure 12A:
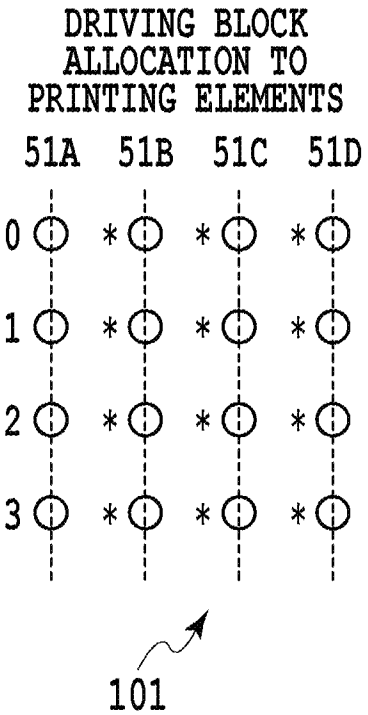
FIGS. 12A to 12C are schematic diagrams specifically illustrating the processing content of the flowchart of FIG. 9.
Figure 12B:
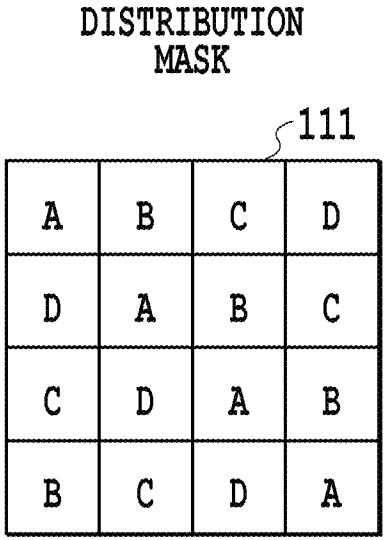
Figure 12C:
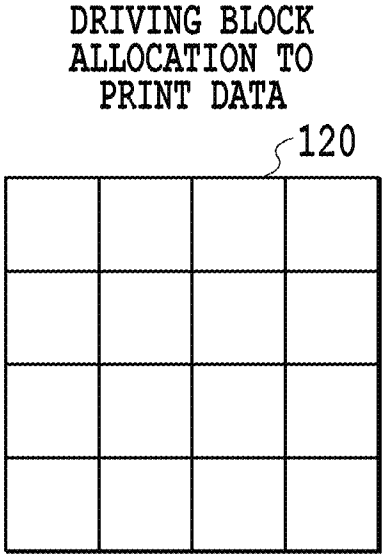

In S940, a driving block (a driving order in block-division driving) is assigned to each printing element in the first printing element array 51A. Since N=4, values from 0 to 3 may be randomly assigned one by one, but here, values from 0 to 3 are assigned from the top as in a driving block allocation 101 as shown in FIG. 12A.

Figure 13A:
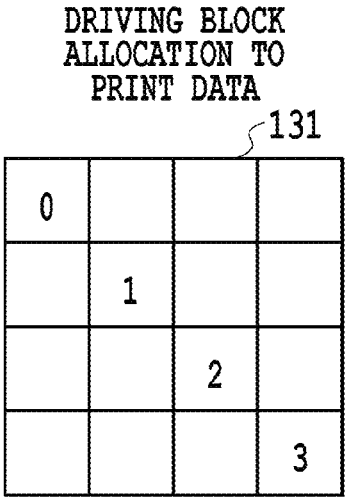
FIGS. 13A to 13D are schematic diagrams specifically illustrating the processing content of the flowchart of FIG. 9.
Figure 13B:
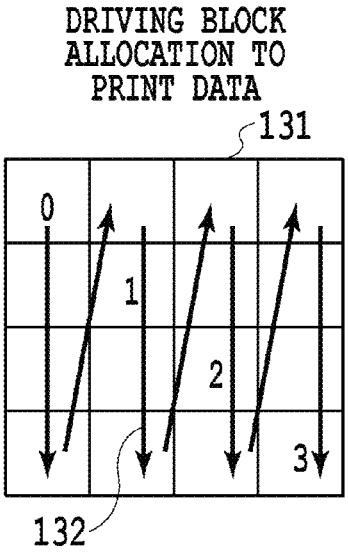

In S950, with reference to the driving block allocation to each printing element in the printing element array 51A in which allocation has already been finished in the driving block allocation 101 and the distribution mask 111, driving blocks allocated to print data are obtained. More specifically, in the distribution mask 111, "A" associated with data to be printed by each printing element in the printing element array 51A is searched, and assigned driving blocks 0 to 3 in the driving block allocation 101 are written into corresponding positions in a matrix 120. As a result, a driving block allocation 131 to print data as shown in FIG. 13A is obtained.

In the following S960, based on the assigned driving blocks in the driving block allocation 131, driving block allocation to print data to which a driving block is not assigned yet is sequentially determined. The order of determination is shown by an arrow 132 in FIG. 13B. It is preferable that the allocation be determined so that the same value is aligned in a vertical direction of the matrix 120 as possible to obtain more favorable straightness. However, it is only sufficient to configure a plurality of printing elements to be driven at driving timings less than the number of segments of the plurality of printing elements. For example, if N=4, when a driving timing "0" assigned to pixels in the first column is set as a reference, the same effect can be obtained even if driving blocks except for "3" are assigned to the pixels in the second and the following columns, for example. In a case where a printing element array driven at the same driving timing cannot be assigned, it is desirable to set the printing element array driven at a driving timing close to a reference driving timing as possible.

The processing of S960 will be described in more detail. According to the arrow 132, a driving block at a position 133 in the driving block allocation 131 is referenced. Since the driving block "0" is assigned to the position 133, an assigned value is retained. If no driving block is assigned, another row in the same column is referenced until a position to which a driving block is assigned is found.

Figure 13C:
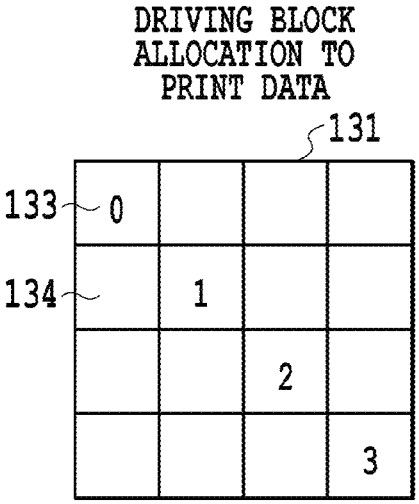
Figure 13D:
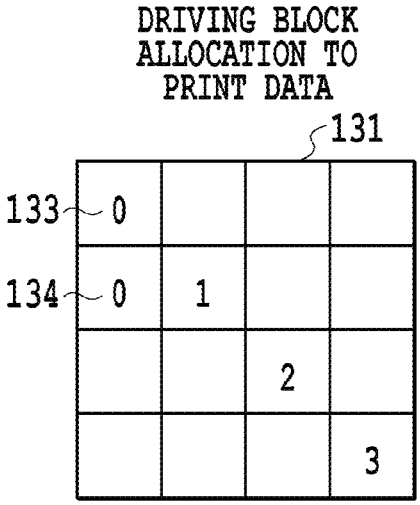

Still according to the arrow 132, a driving block at a position 134 shown in FIG. 13C is referenced. Since no driving block is assigned at the position 134, the retained assigned value "0" is set to the position 134 as a value of the driving block as shown in FIG. 13D. Note that in the exemplary embodiment, since only one driving block of "0" is assigned to a first column in the driving block allocation 131 in the processing of S940, the same value is set to obtain more favorable straightness.

Figure 14C:
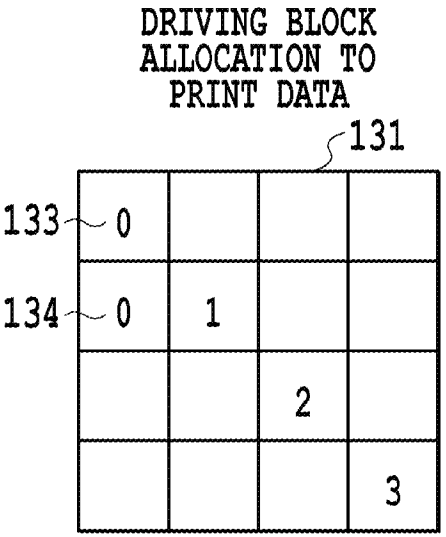
FIGS. 14A to 14C are schematic diagrams specifically illustrating the processing content of the flowchart of FIG. 9.
Figure 14B:
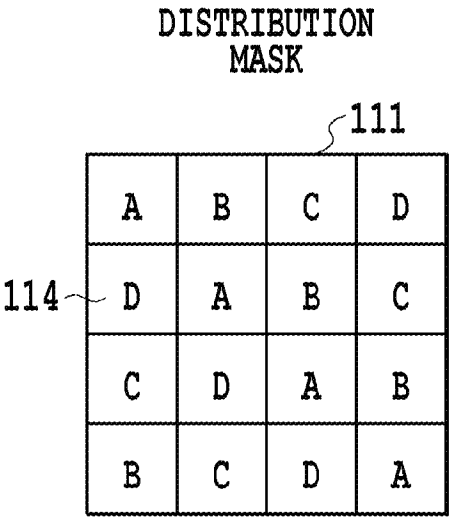
Figure 14A:
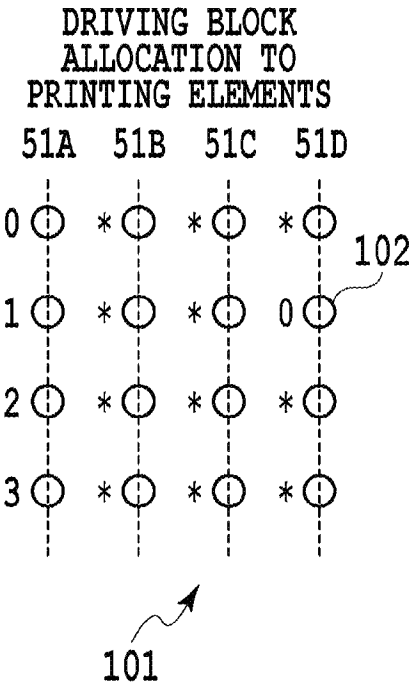

Next, to obtain information about which printing element performs printing at the position 134 of print data, a position 114 corresponding to the position 134 of the distribution mask 111 as shown in FIG. 14B is referenced. The array "D" is shown at the position 114. Accordingly, as shown in FIG. 14A, as a printing element for performing printing with respect to the position 134 of print data, the driving block 0 is set to a printing element 102 which is the second printing element in the printing element array 51D.

Figure 15A:
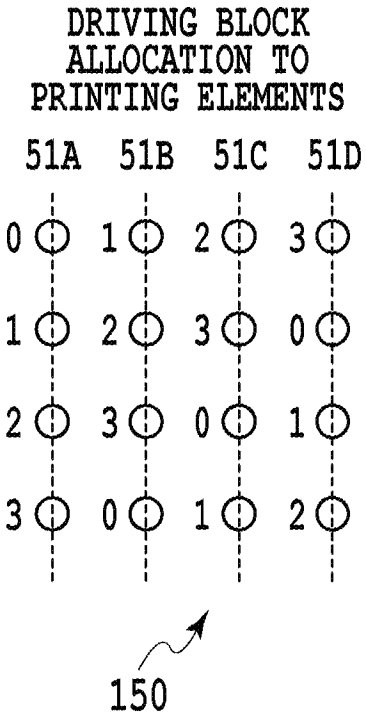
FIGS. 15A to 15C are schematic diagrams specifically illustrating the processing content of the flowchart of FIG. 9.
Figure 15B:
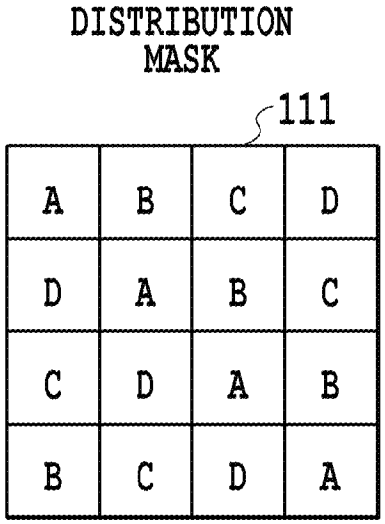
Figure 15C:
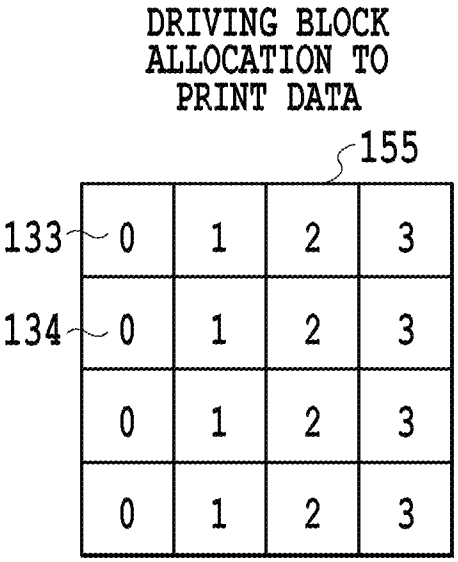

The above-described processing in S960 is repeated according to determination processing in S970, so that the driving blocks that are unassigned in the driving block allocation 131 are sequentially determined. As a result, a driving block allocation 155 to print data is finally obtained as shown in FIG. 15C, and a driving block allocation 150 for all of the printing elements in the printing element arrays 51A to 51D are obtained as shown in FIG. 15A.

<Example of Driving Blocks Allocated to Print Data (FIGS. 16A to 17A)>

Figure 16A:
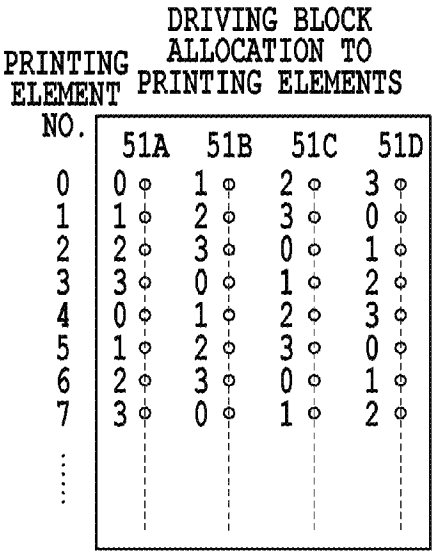
FIGS. 16A to 16C are diagrams showing exemplary driving blocks and an exemplary output image.
Figure 16B:
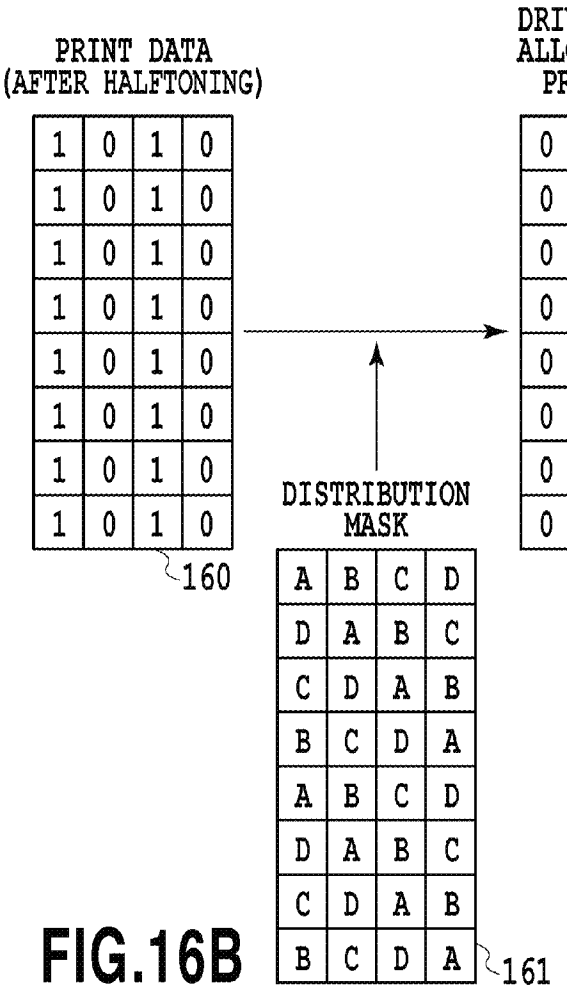
Figure 16C:
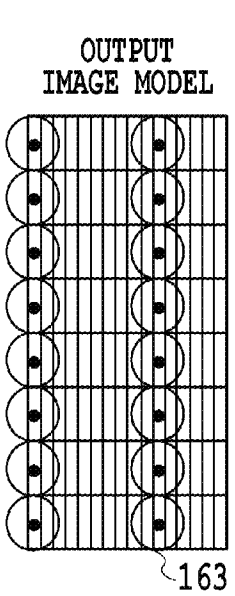

FIGS. 16A to 16C are diagrams showing exemplary driving blocks and an exemplary output image when print data is allocated to the printing elements according to the first embodiment. FIG. 16A is a diagram showing block numbers of driving blocks to which the printing elements in the print chip 51 belong at the left side of the printing elements. For simplicity, only the printing elements of printing element Nos. 0 to 7 are shown for each array. FIG. 16B illustrates, in a case where a distribution mask is configured according to the above-described algorithm and a block driving order is assigned to the printing elements in the print chip 51 as shown in FIG. 16A, the distribution mask is used to perform allocation of driving blocks to print data.

As an example of print data 160, halftone data is used herein to represent by 1 a pixel to which a dot is printed and to represent by 0 a pixel to which a dot is not printed. The print data 160 corresponds to an image pattern formed on the print medium, including two thin lines in the arrangement direction of printing elements (a vertical direction) having a one-pixel width with an interval corresponding to the one-pixel width. By applying a distribution mask 161 to the print data 160, each dot of the print data 160 is distributed to one of the printing elements in the printing element arrays A, B, C, and D of the print chip 51, and a driving block is assigned to each dot. A driving block allocation 162 is generated for the print data 160. The distribution mask 161 is repeatedly applied so that pixels of the print data 160 are allocated to all of the printing elements of the print head.

A description will be given of how driving blocks (0 to 3) are allocated to the pixel group of the print data 160.

For example, a pixel of a pixel value of 1 in the top row in the leftmost column of the print data 160 corresponds to a value of A in the distribution mask 161. This value represents that the pixel is printed by the printing element array 51A. Furthermore, of the printing elements in the printing element array 51A, this pixel is printed by the printing element of printing element No. 0 at a corresponding position in the arrangement direction of printing elements, and with reference to FIG. 16A, it is understood that the printing element of printing element No. 0 is driven by the first driving block (0). In the same manner, driving blocks are allocated to other pixels so as to be printed by the printing elements of the printing element No. 0 in the printing element arrays 51B, 51C, and 51D according to values of B, C, and D which are corresponding values in the distribution mask 161 in the order of the main scanning direction. With reference to FIG. 16A, the first driving block (0), the second driving block (1), the third driving block (2), and the fourth driving block (3) are assigned to the printing elements in the order of the main scanning direction. The resulting allocation is represented as shown in the top row in the driving block allocation 162.

With respect to the following row, the block driving order assigned to the printing elements of printing element No. 1 in the printing element arrays 51B, 51C, and 51D is different from that of the top row. Further, the distribution order of the distribution mask 161 is D, A, B, and C in the order of the main scanning direction, which is different from that of the top row in the distribution mask 161. As a result of applying the distribution mask 161 in the same manner to the pixels in the following row of the print data 160, the first driving block (0), the second driving block (1), the third driving block (2), and the fourth driving block (3) are assigned to the printing elements in the order of the main scanning direction. In the same manner, the same driving block is assigned in the arrangement direction of printing elements as the driving block allocation 162 to the printing elements of printing element No. 2 onward. More specifically, one line in a direction crossing the main scanning direction on the print medium is printed at a single driving timing which is less than the number of segments 4.

When the heaters for the printing elements are driven according to the driving block allocation 162, dots corresponding to the pixels in the first column having the pixel value of 1 in the first driving block (0) are printed in a line in the array direction on the print medium, whereas pixels in the second column having the pixel value of 0 in the second driving block (1) are not printed. Then, dots corresponding to the pixels in the third column having the pixel value of 1 in the third driving block (2) are printed in a line in the array direction on the print medium, whereas pixels in the fourth column having the pixel value of 0 in the fourth driving block (3) are not printed. According to the present embodiment, like the output image 163 as schematically shown in FIG. 16C, each of the two thin lines in the arrangement direction of printing elements (the vertical direction in FIG. 16C) can be printed in a line without raggedness.

Each dot corresponding to each pixel in the first column is printed in the following manner described in detail. First, the printing element of printing element No. 0 in the printing element array 51A is driven at a driving timing 81 in the first driving block (0), and a dot is printed on the top. Then, the printing element of printing element No. 3 in the printing element array 51B is driven at a driving timing 82 in the first driving block (0), and a dot is printed on the fourth position from the top. Then, the printing element of printing element No. 2 in the printing element array 51C is driven at a driving timing 83 in the first driving block (0), and a dot is printed on the third position from the top. Then, the printing element of the printing element No. 1 in the printing element array 51D is driven at a driving timing (not shown) in the first driving block (0), and a dot is printed on the second position from the top. In this manner, the left thin line in the output image 163 is printed. The right thin line is printed in the same manner at driving timings 84 and 85 in the third driving block (2) or the like.

Figure 17C:
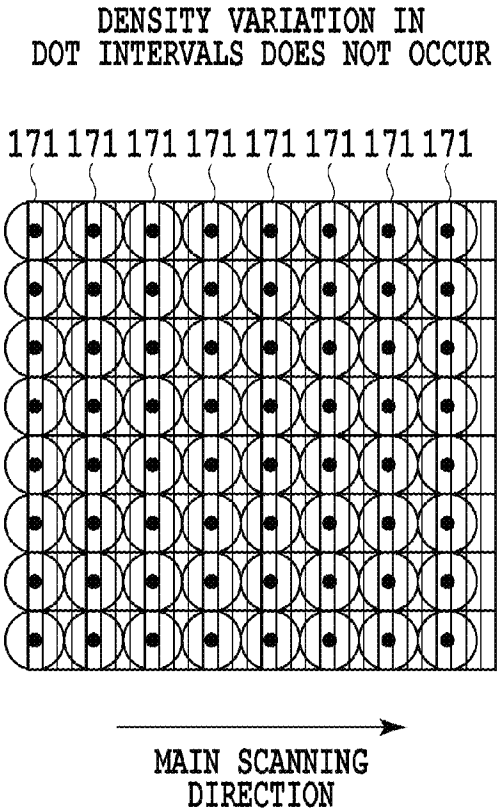
FIGS. 17A to 17C are schematic diagrams illustrating a method of avoiding density variation in dot intervals on a print medium.
Figure 17B:
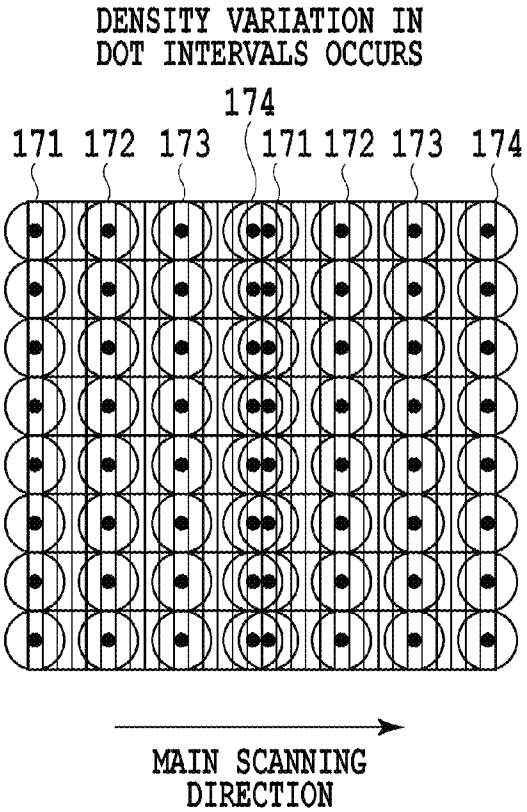
Figure 17A:
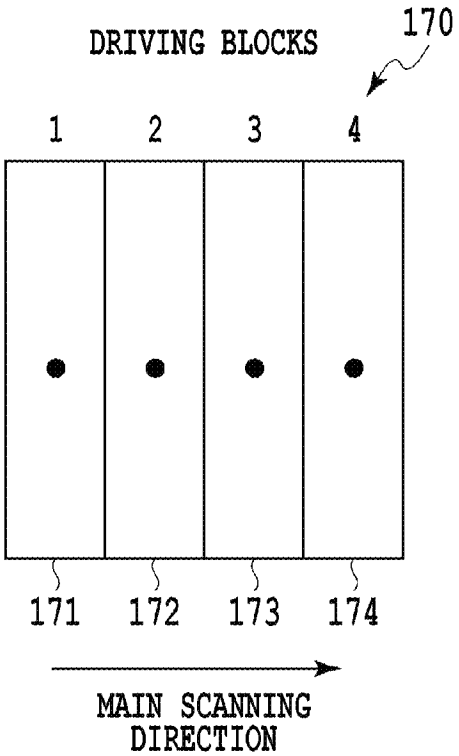

Note that due to block-division driving which drives blocks at different timings, positions at which dots corresponding to the pixel group of print data are formed vary in a pixel area on the print medium corresponding to the pixels. More specifically, as shown in landing displacements by driving timings shown in FIG. 17A, in one of four areas divided in the main scanning direction, a dot is printed around a position shown by a filled circle according to the driving order of each driving block. FIG. 17A shows that a dot is printed in a first area 171 of a pixel area 170 in the main scanning direction in a case where the printing element is driven in the first driving block (0), whereas a dot is printed in a last area 174 of the pixel area 170 in the main scanning area in a case where the printing element is driven in the fourth driving block (3).

<To Avoid Density Variation in Dot Intervals (FIGS. 17B and 17C)>

In a case where the same driving block is assigned in the arrangement direction of printing elements, positions at which dots, corresponding to the pixels of print data, formed according to the driving block within the pixel area on the print medium vary in the main scanning direction. This is as shown in the example of FIG. 16C. For the same reason, in a case where print data for printing all of the 8×8 pixels is given, for example, density variation in dot intervals occurs in the main scanning direction as shown in FIG. 17B.

More preferably, to avoid such a phenomenon, in printing a dot associated with the second driving block (1), for example, an ejection timing of a dot may be advanced by T/4 so that the dot lands not onto an area 172 but onto the area 171 in the first driving block (0). In the same manner, in printing a dot associated with the third driving block (2), an ejection timing of a dot may be advanced by 2T/4, and in printing a dot associated with the fourth driving block (3), an ejection timing of a dot may be advanced by 3T/4.

In a modification example, the print chip may be manufactured such that physical positions of the printing element arrays are shifted so that all of the dots land onto the area 171 in the first driving block (0). According to the above improved embodiment, it is possible to avoid the above phenomenon in which density variation in dot intervals occurs in the main scanning direction, and dots can be regularly arranged as shown in FIG. 17C.

<Configuration of an Image Printing Unit and Processing Flow (FIGS. 18 and 19)>

Figure 18:
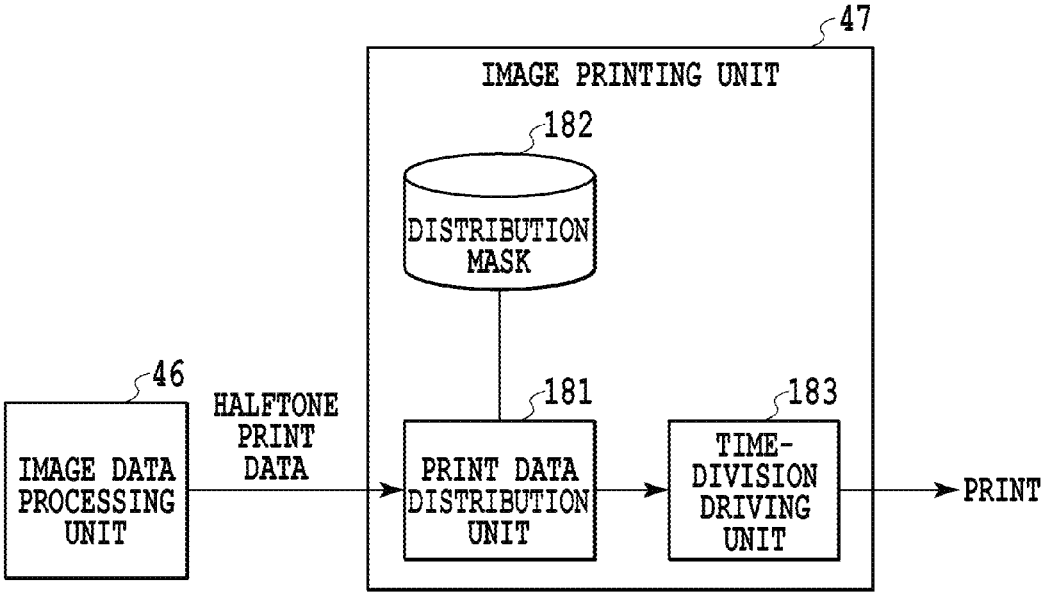
FIG. 18 is a detailed block diagram showing an image printing unit.

FIG. 18 is a block diagram illustrating in more detail the configuration of the image printing unit 47 according to the first embodiment. The image printing unit 47 includes a print data distribution unit 181, a distribution mask 182, and a time-division driving unit 183. The image printing unit 47 receives halftone data generated in the image data processing unit 46 and generates driving signals for printing an image.

Figure 19:
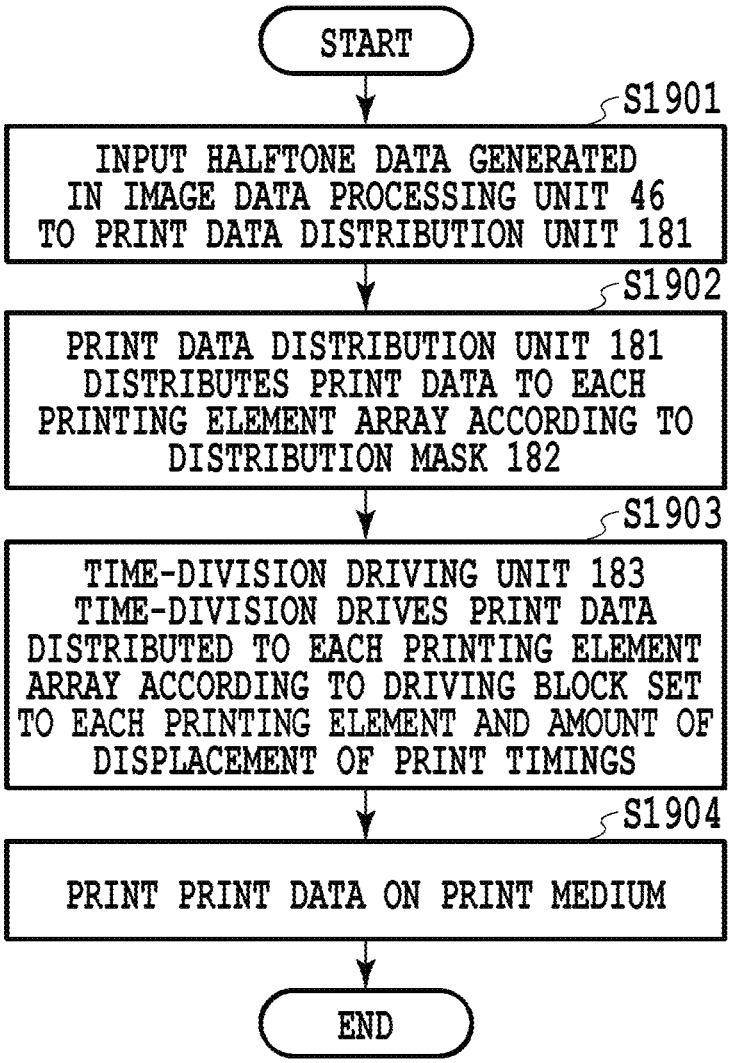
FIG. 19 is a flowchart showing the processing content of the image printing unit.

FIG. 19 is a flowchart showing the processing content of the image printing unit 47 according to the first embodiment. First, in S1901, the halftone data generated in the image data processing unit 46 is input to the print data distribution unit 181. Next, in S1902, the print data distribution unit 181 distributes print data to each printing element array according to the distribution mask 182. After that, in S1903, the time-division driving unit 183 time-division drives print data distributed to each printing element array according to the driving block set to each printing element and the amount of displacement of print timings. Finally, in S1904, printing is performed on the print medium according to the print data.

Note that in the above description, the example of part of the printing elements in the print chip 51 is shown. The present embodiment can be applied similarly to other printing elements and print chips. Furthermore, the numbers of printing element arrays, printing elements provided for each printing element array, driving blocks, and sections for time-division driving may be set or designated to any numbers according to the configurations of the printing apparatus and the print head. For example, the number of printing element arrays may be set to 8, the number of printing elements provided for each printing element array to 1024, the number of driving blocks to 8, the number of sections for time-division driving to 128, and the like.

In addition, the present embodiment can be applied similarly to the connection portions provided for each print chip. More specifically, in the connection portion, after the print data is distributed to two print chips which form a connection portion, the present embodiment can be applied in the same manner.

Comparative Example

A description will be given of a comparative example for comparison with the first embodiment while comparing with the first embodiment.

Figure 20:
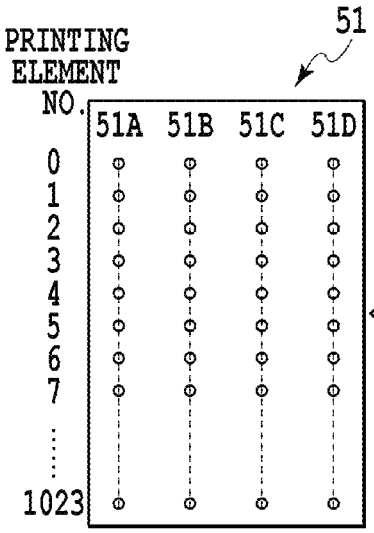
FIG. 20 is a diagram showing exemplary driving blocks allocated to printing elements according to a comparative example.

FIG. 20 is a diagram showing printing element arrays and exemplary driving blocks allocated to the printing elements in each printing element array according to the present comparative example.

Also in the present comparative example, the same print chip 51 as the one in the first embodiment is used. In the present comparative example, as shown in a driving block allocation table 200, the order of driving blocks in an arrangement direction of printing elements is the same in all of four printing element arrays 51A, 51B, 51C, and 51D. Then, to the printing elements of printing element Nos. 0 to 1023, driving blocks 0, 1, 2, and 3 are repeatedly set in the order mentioned.

Figure 21:
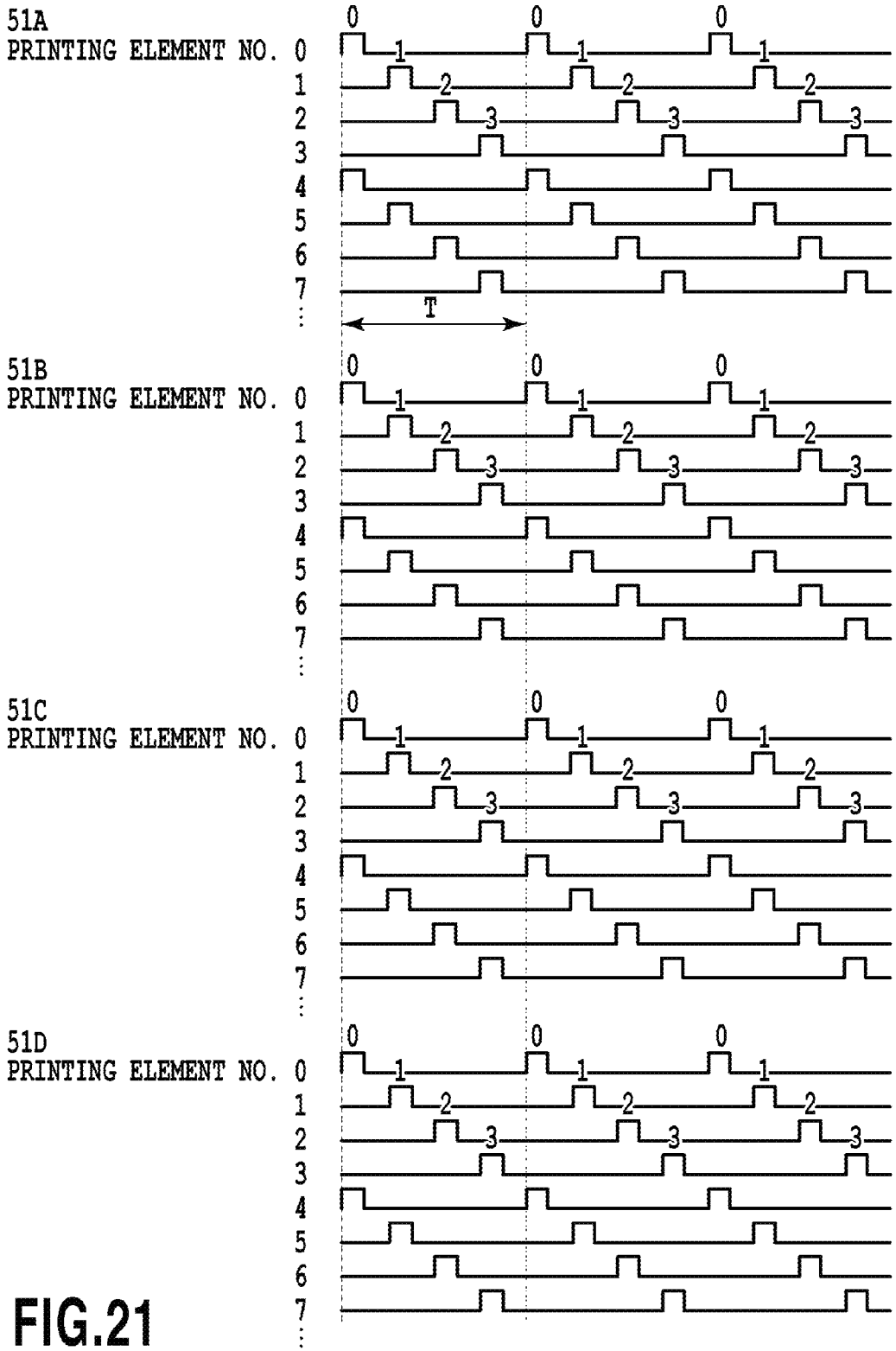
FIG. 21 is a timing diagram showing a driving timing for each printing element according to the comparative example.

FIG. 21 is a timing diagram showing a timing of a pulse driving signal for determining a driving timing of a heater corresponding to each printing element. Driving signals corresponding to printing elements of printing element Nos. 0 to 7 are shown in each of printing element arrays 51A, 51B, 51C, and 51D. In the present comparative example, the timings of driving signals in all printing element arrays are the same. The printing elements in each of the printing element arrays 51A, 51B, 51C, and 51D are sequentially driven by pulse driving signals in ascending numeric order from a first driving block (0) to a fourth driving block (3).

FIGS. 22A to 22C are diagrams showing exemplary driving blocks and an exemplary output image when print data is allocated to the printing elements according to the present comparative example.

FIG. 22A is a diagram showing block numbers of driving blocks to which the printing elements in the print chip 51 belong at the left side of the printing elements. For simplicity, only the printing elements of printing element Nos. 0 to 7 are shown for each array. As different from the first embodiment, in all of the printing element arrays, the same driving block is assigned to the printing elements having the same printing element number.

The same print data 160 and the distribution mask 161 (FIG. 22B) are used as those in the first embodiment.

To each of the printing elements in the printing element arrays 51A, 51B, 51C, and 51D to which block driving orders are set as shown in FIGS. 20 and 22A, the distribution mask 161 is applied and the print data 160 is distributed. Accordingly, a driving block allocation 222 as shown in FIG. 22B is obtained. In the present comparative example, as shown in FIG. 22B, the same driving block allocation is set to each printing element array.

According to the present comparative example, each of two vertical thin lines is printed not in a line but in a ragged manner as shown in an output image 223 as schematically shown in FIG. 22C. Accordingly, straightness of the thin lines is reduced as compared to the first embodiment.

Second Embodiment

In the first embodiment, the same driving block is assigned to each of a plurality of pixel areas arranged in a direction corresponding to an arrangement direction of printing elements on a print medium, and a vertical thin line is printed in a line while setting to zero the amount of displacement in a main scanning direction of dot positions of dots formed in each pixel area. However, the first embodiment is an example in which straightness is obtained in every line in the arrangement direction of printing elements in a case where both of the number of printing element arrays and the number of driving blocks are four. If the number of driving blocks is greater than the number of printing element arrays, such straightness may not be obtained. In the present embodiment, there is provided a configuration of obtaining more favorable straightness in every line even in a case where the number of driving blocks is greater than the number of printing element arrays by restricting the amount of displacement in the main scanning direction as possible.

A description will be given of a second embodiment in which the number of printing element arrays is set to 4, the number of printing elements provided for each printing element array to 1024, the number of driving blocks to 8, and the number of sections in time-division driving to 128.

FIG. 23 is a diagram showing driving blocks allocated to the printing elements in each printing element array according to the second embodiment.

In an exemplary driving block allocation table 230 as shown in FIG. 23, a first driving block (0) is assigned to 128 printing elements, that is, every eight printing elements, from the printing element of printing element No. 0 in the printing element array 51A. Likewise, a second driving block (1) is assigned to 128 printing elements, that is, every eight printing elements, from the printing element of printing element No. 4 in the printing element array 51A. In the same manner, a third driving block (2) to an eighth driving block (7) are assigned to every 128 printing elements.

Figure 24A:
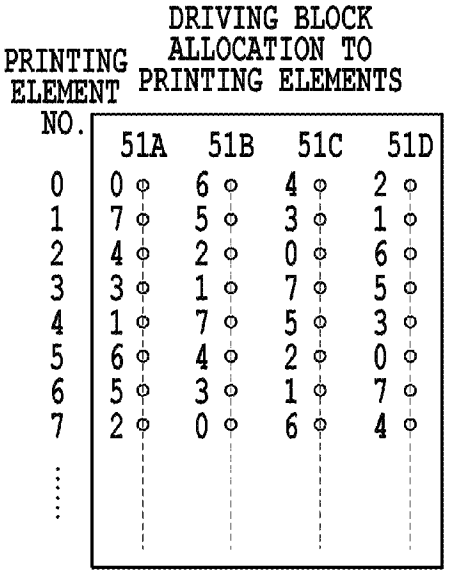
FIGS. 24A to 24C are diagrams showing exemplary driving blocks and an exemplary output image according to the second embodiment.
Figure 24B:
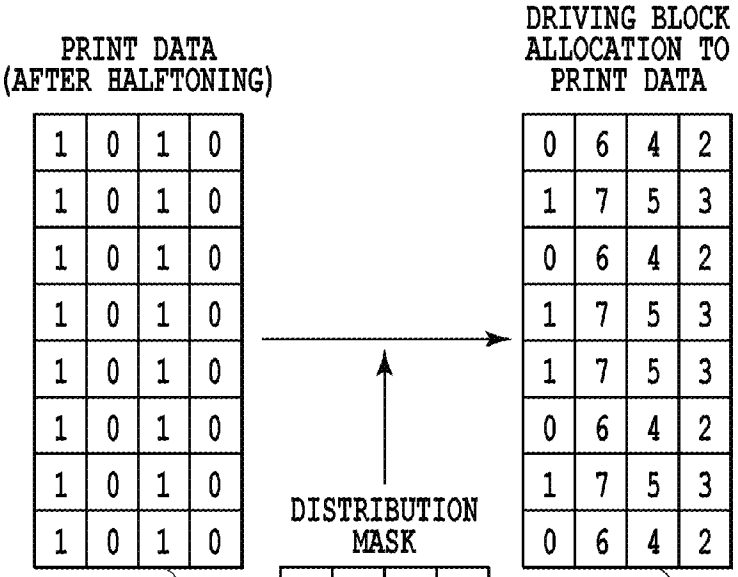
Figure 24C:
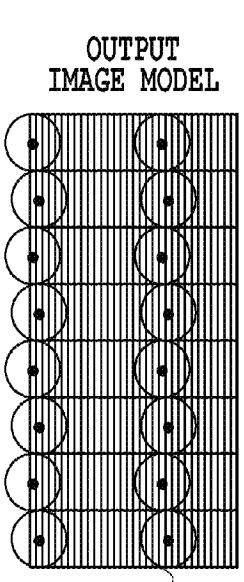

With respect to the printing element arrays 51B, 51C, and 51D, eight driving blocks (0 to 7) are allocated as shown in FIG. 23 like the printing element array 51A. FIGS. 24A to 24C are diagrams showing exemplary driving blocks and an exemplary output image when print data is allocated to the printing elements according to the second embodiment.

FIG. 24A is a diagram showing block numbers of driving blocks to which the printing elements in the print chip 51 belong at the left side of the printing elements. For simplicity, only the printing elements of printing element Nos. 0 to 7 are shown for each array.

Also in the processing of S940 in the present embodiment, a driving block (driving order in block-division driving) is assigned to each printing element in the first printing element array 51A. In the present embodiment, since N=8, values from 0 to 7 are randomly assigned one by one (FIG. 24A). Then, in the processing of S960 in the present embodiment, a driving block is sequentially determined for print data 160 corresponding to the first printing element array 51A such that a driving block of "0" does not follow a driving blocks "1" as possible (and vice versa) (FIG. 24B). Note that the same print data 160 and the distribution mask 161 (FIG. 24B) are used as those in the first embodiment.

To each of the printing elements in the printing element arrays 51A, 51B, 51C, and 51D to which block driving orders are set as shown in FIG. 23, the distribution mask 161 is used and the print data 160 is distributed. Accordingly, a driving block allocation 242 as shown in FIG. 24B is obtained.

In a case where a print head is driven according to the driving block allocation 242 and the print data 160 is printed on the print medium, with respect to pixels in the leftmost column of the print data 160, for example, in the order from the top, the printing elements are driven alternately in the first driving block (0) and the second driving block (1). More specifically, one line in a direction crossing the main scanning direction on the print medium is printed on the print medium in two adjacent driving timings, which is less than the number of segments 8. As a result, according to the present embodiment, as shown in an output image 243 schematically shown in FIG. 24C, it is possible to reduce the amount of dot landing displacement in the main scanning direction to ⅛ a width of a pixel area in the arrangement direction of printing elements. Accordingly, it is possible to perform printing substantially in a line.

Incidentally, in accordance with the algorithms of the embodiments shown in the flowcharts and the schematic diagrams of FIGS. 9 to 15C, if the number of block segments is N and the number of printing element arrays is L (N and L are integers greater than 1), the pixels are distributed to the printing element arrays so that one line in the arrangement direction of printing elements is printed in driving timings less than the number of block segments N. Note that the smallest number of driving timings to print one line in the arrangement direction of printing elements is N/L.

In the first embodiment, a distribution mask is configured for setting printing element arrays so that a plurality of pixels arranged in a direction corresponding to the arrangement direction of printing elements are printed on the print medium at the same driving timing as possible so as to set to zero the displacement in the main scanning direction of positions of dots formed. In the second embodiment, to reduce the displacement to ⅛ a width of a pixel area, a distribution mask for setting a printing element array to each pixel. As described above, in a control system of a printer (printing apparatus) of the present embodiment, the displacement is suppressed in the main scanning direction to a limited portion of the pixel area so as to improve straightness of lines printed in the direction corresponding to the arrangement direction of printing elements. Accordingly, in the control system of the printer (printing apparatus) of the present embodiment, a printing element array is assigned to each pixel in turn based on the driving timings at which pixels in the same line in the arrangement direction of the printing elements are printed. In particular, it is preferable that a printing element array to be assigned to a certain pixel be either a printing element array driven at the same driving timing as a driving timing at which a pixel in the same line is printed or a printing element array driven at the following driving timing.

Also in the present embodiment, density variation in dot intervals occurs as described in the first embodiment, and the same method for avoidance can be employed. More specifically, also in printing dots associated with the second driving block (1) to the eighth driving block (7), ejection timings of dots may be advanced by respective time intervals so that the dots land onto an area 171 in the first driving block (0). In a modification example, a print chip may be manufactured in a manner that the physical positions of the printing element arrays are staggered so that all dots land onto the area 171 in the first driving block (0).

Incidentally, in the second embodiment, a description is given of part of printing elements in the print chip 51 as in the first embodiment. However, the present embodiment can be applied similarly to other printing elements and print chips. Furthermore, the numbers of printing element arrays, printing elements provided for each printing element array, driving blocks, and sections for time-division driving may be set or designated to any numbers according to the configurations of the printing apparatus and the print head. For example, the number of printing element arrays may be set to 8, the number of printing elements provided for each printing element array to 1024, the number of driving blocks to 16, the number of sections for time-division driving to 64, and the like.

In addition, the present embodiment can be applied to a connection portion like the first embodiment.

Third Embodiment

The above-described first and second embodiments are examples using the distribution mask 161 that is relatively small in size for a simple distribution method. However, the size of a distribution mask and a distribution method are not limited to these examples. Distribution masks having various characteristics of any size may be set, for example, distribution masks of a Bayer type, a dot concentration type, a blue noise mask type, and the like.

Fourth Embodiment

The above-described first to third embodiments employ the configuration (FIG. 18) in which halftone data generated in the image data processing unit 46 is distributed to each printing element array by the print data distribution unit 181 in the image printing unit 47. In a fourth embodiment, a description will be given of an example of a printing apparatus having a configuration of performing image processing to obtain print data for each printing element array by distributing post color separation data to each printing element by a predetermined ratio and performing halftone processing on the distributed data. The description of the same configuration as those of the first to third embodiments will be omitted and a different configuration will be described.

Figure 25:
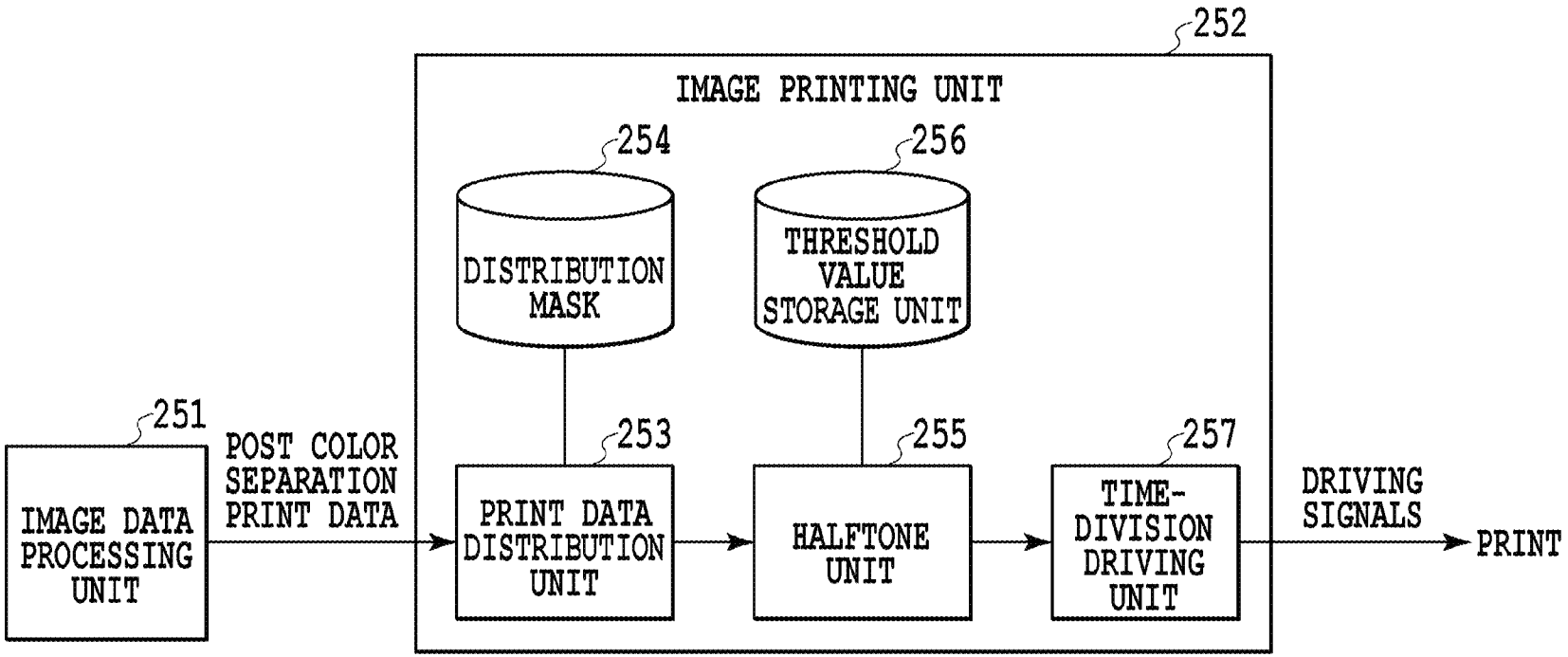
FIG. 25 is a detailed block diagram showing an image printing unit according to a fourth embodiment.

FIG. 25 is a detailed block diagram showing a configuration of an image printing unit 47 according to the fourth embodiment.

An image data processing unit 251 outputs post color separation print data and transmits it to an image printing unit 252. A print data distribution unit 253 distributes the received post color separation print data to each printing element array according to a mask stored in a distribution mask 254. A halftone unit 255 applies halftone processing individually to the distributed print data according to a threshold value matrix stored in a threshold value storage unit 256. A time-division driving unit 257 generates driving signals for the halftone data.

As in the present embodiment, even in the case of performing halftone processing after a distribution mask is applied to the print data, like the first to third embodiments, the print data can be printed on a print medium in a line in an arrangement direction of printing elements.

Other Embodiments

While an ink jet type is described in the above-described embodiments, any printer can carry out the above-described embodiments as long as it has printing element arrays and each printing element is driven by time-division driving. For example, a printer of, for example, a thermal type or an electrophotography type by LED exposure may be used. Further, in the above-described embodiments, examples are given, but not by way of limitation, of using a distribution mask as distribution information indicating that each of the pixels forming image data is associated with one of the plurality of printing elements. The distribution information may be implemented as a table in which pixel positions are associated with printing elements for printing pixels at the pixel positions.

While a configuration of only an ink jet printer is shown in the above-described embodiments, the above-described embodiments may be applied to a system provided with a plurality of devices (for example, a host computer, an interface device, a reader, and a printer). Further, as described above, image data processing is performed in a printing apparatus, but may also be performed in an external device (a computer) for controlling a printing apparatus. In this case, the external device performs determination processing on binary data for each ejection port array (printing element array) and transfer the binary data to the printing apparatus, and the printing apparatus performs printing based on the transferred data.

In the specification, the term "print" represents not only to form significant information such as letters or graphics but also, whether significant or nonsignificant, to form images, figures, patterns, or the like on a print medium in general or to process a medium. In addition, whether or not the information is displayed so that a human can visually recognize it would not be questioned.

Further, the term "print medium" represents not only paper used for general printing apparatuses but also a medium in general that can accept ink, such as cloth, plastic films, metal plates, glass, ceramics, wood, and leather.

Still further, the term "ink" should be widely interpreted as the definition of the above-mentioned "print". It represents a liquid that may be associated with formation of images, figures, patterns, or the like, processing of print media, or processing of ink, by being applied onto print media. Furthermore, examples of the processing of ink include solidification or insolubilization of a coloring agent contained in ink applied onto print media.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-046528, filed Mar. 10, 2014, which is hereby incorporated by reference wherein in its entirety.

What is claimed is:

1. A control device for a printing apparatus provided with a print head in which a plurality of printing element arrays each having a plurality of printing elements arranged therein are placed in parallel in a direction crossing an arrangement direction of the plurality of printing elements, wherein the print head and a print medium opposite to the print head are relatively moved in the direction crossing the arrangement direction of the plurality of printing elements to print an image on the print medium by the print head, the control device comprising:

an acquisition unit configured to acquire image data;

a distribution unit configured to assign each pixel in the image data to a printing element for outputting a pixel value of the pixel according to distribution information indicating that each of the pixels forming the image data is associated with one of the plurality of printing elements; and a control unit configured to control printing of the image data by driving the plurality of printing elements by time-division driving in which a different driving timing is set for each printing element according to assignment by the distribution unit, wherein the control unit drives the plurality of printing elements such that the plurality of printing elements included in each printing element array correspond to a plurality of different driving timings respectively and further the plurality of printing element arrays have different orders of driving timings for the respective printing elements in the arrangement direction of the plurality of printing elements, and wherein the distribution information is set such that, with respect to a pixel group corresponding to the arrangement direction of the plurality of printing elements, of the printing elements that can print a pixel included in the pixel group, a printing element driven at a reference driving timing or a driving timing close to the reference driving timing is assigned to the pixel.

2. The control device according to claim 1, wherein in the distribution information, a printing element assigned to a target pixel is determined based on a driving timing at which a pixel adjacent to the target pixel in the arrangement direction of the plurality of printing elements is printed.

3. The control device according to claim 2, wherein the distribution information assigns to the target pixel a printing element that prints at a driving timing that is the same as or adjacent to a driving timing at which an adjacent pixel in the arrangement direction of the plurality of printing elements is printed.

4. The control device according to claim 1, wherein the distribution information further determines a printing element assigned to the pixel based on a dot landing displacement that occurs when the print head prints an image.

5. The control device according to claim 1, wherein the distribution information assigns a printing element that prints the pixel by designating one of the plurality of printing element arrays.

6. The control device according to claim 1, wherein in the distribution information, a first pixel group corresponding to the arrangement direction of the plurality of printing elements and a second pixel group corresponding to the arrangement direction of the plurality of printing elements, the second pixel group being different from the first pixel group, are set based on different reference driving timings.

7. The control device according to claim 1, wherein the distribution information is held as a distribution mask.

8. A printing apparatus having the control device according to claim 1, wherein the print head is an ink jet print head.

9. A control method for a printing apparatus provided with a print head in which a plurality of printing element arrays each having a plurality of printing elements arranged therein are placed in parallel in a scanning direction crossing an arrangement direction of the plurality of printing elements, wherein the print head and a print medium opposite to the print head are relatively moved in a direction crossing the arrangement direction of the plurality of printing elements to print an image on the print medium by the print head, the control method comprising:

acquiring image data;

distributing to assign each pixel in the image data to a printing element for outputting a pixel value of the pixel according to distribution information indicating that each of the pixels forming the image data is associated with one of the plurality of printing elements; and controlling printing of the image data by driving the plurality of printing elements by time-division driving in which a different predetermined driving timing is set for each printing element according to assignment in the distribution step, wherein in the step of controlling, the plurality of printing elements are driven such that the plurality of printing elements included in each printing element array correspond to a plurality of different driving timings respectively and further the plurality of printing element arrays have different orders of driving timings for the respective printing elements in the arrangement direction of the plurality of printing elements, and wherein the distribution information is set such that, with respect to a pixel group corresponding to the arrangement direction of the plurality of printing elements, of the printing elements that can print a pixel included in the pixel group, a printing element driven at a reference driving timing or a driving timing close to the reference driving timing is assigned to the pixel.

* * * * *